US011660176B2

(12) United States Patent
Zong et al.

(10) Patent No.: US 11,660,176 B2
(45) Date of Patent: May 30, 2023

(54) UNIVERSAL PLATFORM FOR ACCURATELY INJURING ANIMAL UNDER MULTI-CONDITION AND MULTI-SIMULATION-ENVIRONMENT

(71) Applicant: ARMY MEDICAL UNIVERSITY, PEOPLE'S LIBERATION ARMY, PRC, Chongqing (CN)

(72) Inventors: Zhaowen Zong, Chongqing (CN); Wenqiong Du, Chongqing (CN); Renqing Jiang, Chongqing (CN); Lin Zhang, Chongqing (CN); Xin Zhong, Chongqing (CN); Yijun Jia, Chongqing (CN); Zhao Ye, Chongqing (CN); Xiaolin Zhou, Chongqing (CN)

(73) Assignee: ARMY MEDICAL UNIVERSITY, PEOPLE'S LIBERATION ARMY, PRC, Chongqing (CN)

( * ) Notice: Subject to any disclaimer, the term of this patent is extended or adjusted under 35 U.S.C. 154(b) by 228 days.

(21) Appl. No.: 17/293,922

(22) PCT Filed: Feb. 27, 2020

(86) PCT No.: PCT/CN2020/076888
§ 371 (c)(1),
(2) Date: May 14, 2021

(87) PCT Pub. No.: WO2021/168718
PCT Pub. Date: Sep. 2, 2021

(65) Prior Publication Data
US 2022/0387157 A1 Dec. 8, 2022

(30) Foreign Application Priority Data
Feb. 24, 2020 (CN) ..... 202010118727.5

(51) Int. Cl.
*A61D 1/00* (2006.01)
*A61D 3/00* (2006.01)

(52) U.S. Cl.
CPC ..... *A61D 1/00* (2013.01); *A61D 3/00* (2013.01)

(58) Field of Classification Search
CPC ..... A61D 1/00; A61D 3/00; A61D 2003/003; A61D 2003/006; A61D 7/00; A61D 7/04
(Continued)

(56) References Cited

U.S. PATENT DOCUMENTS

2003/0111021 A1* 6/2003 Lee ..... A61D 3/00 119/417
2009/0205581 A1* 8/2009 Palmer ..... A01K 15/02 119/712
(Continued)

FOREIGN PATENT DOCUMENTS

CN 102411865 A 4/2012
CN 102697573 A 10/2012
(Continued)

*Primary Examiner* — Ebony E Evans
(74) *Attorney, Agent, or Firm* — Yu Gang

(57) ABSTRACT

The present disclosure relates to a universal platform for accurately injuring animal under multi-condition and multi-simulation-environment, the platform including a fragment assembly convenient for the animal to be injured by means of a fragment, a shock wave assembly convenient for the animal to be injured by means of shock waves, a low-temperature assembly for providing a low-temperature environment for an injured animal, a low-pressure assembly for providing a low-pressure environment for the injured animal, a burning assembly used for injuring the animal by means of burning, a seawater soaking assembly used for soaking the injured animal in seawater, a photographing assembly used for high-speed photography, and a binding
(Continued)

assembly used for fixing the animal during fragment injury, shock wave injury, burning injury and seawater soaking.

15 Claims, 25 Drawing Sheets

(58) Field of Classification Search
USPC ..... 119/712
See application file for complete search history.

(56) References Cited

U.S. PATENT DOCUMENTS

| | | | | |
|---|---|---|---|---|
| 2010/0331722 | A1* | 12/2010 | Caudle | A01K 29/00 600/557 |
| 2019/0133521 | A1* | 5/2019 | Schoonover | A61B 5/16 |
| 2019/0262114 | A1* | 8/2019 | Friedman | A61B 5/097 |

FOREIGN PATENT DOCUMENTS

| | | | |
|---|---|---|---|
| CN | 103099686 | A | 5/2013 |
| CN | 103417311 | A | 12/2013 |
| CN | 104287860 | A | 1/2015 |
| CN | 109519711 | A | 3/2019 |
| CN | 109730798 | A | 5/2019 |

* cited by examiner

UNIVERSAL PLATFORM FOR ACCURATELY INJURING ANIMAL UNDER MULTI-CONDITION AND MULTI-SIMULATION-ENVIRONMENT

CROSS-REFERENCE TO RELATED APPLICATIONS

The present disclosure is a national stage application of International Patent Application No. PCT/CN2020/076888, which is filed on Feb. 27, 2020. The International Patent application claims priority to Chinese Patent Application No. 202010118727.5 filed on Feb. 24, 2020 and entitled "Universal platform for accurately injuring animal under Multi-condition and multi-simulation-environment", the disclosure of which is hereby incorporated by reference in its entirety.

TECHNICAL FIELD

The present disclosure relates to the technical field of scientific experiment apparatuses, and particularly relates to an universal platform for accurately injuring animal under multi-condition and multi-simulation-environment.

BACKGROUND

In the prior art, there is one basic mode for injuring an animal, for example, injuring by high-pressure airflow shock waves, or injuring by high-speed fragments, or injuring by burning, which is single in function; meanwhile, an environment after injuring the animal is only an actual environment of an experimental site, more severe environment conditions cannot be simulated, and accordingly, the experimental site will be selected according to experimental requirements, which increases a large amount of transportation workload and experimental cost; and besides, in the prior art, there is not completely photographed during an experimental process of the animal, then continuous observation of vital signs is influenced, such that a change condition of the vital signs of the injured animal cannot be accurately mastered, which possibly results in defects in human body injury research.

Therefore, it is urgently needed for designing a universal platform for injuring capable of providing multi-condition injuring modes, various selectable natural environments and a high-speed photography function, so as to provide various experimental conditions, reduce the experimental workload, improve the working efficiency, reduce the experimental cost and improve the human body injury research level.

SUMMARY

In view of this, some embodiments of the present disclosure provide an universal platform for accurately injuring animal under multi-condition and multi-simulation-environment to solve the problems that in the prior art, a complete working platform is in shortage, an injuring mode and an environment may not be selected, and accurate photographing may not be achieved in the whole process.

The present disclosure is achieved by means of the following solution:

An universal platform for accurately injuring animal under multi-condition and multi-simulation-environment includes a fragment assembly used for injuring the animal by means of a fragment, a shock wave assembly used for injuring the animal by means of shock waves, a low-temperature assembly for providing a low-temperature environment for the injured animal, a low-pressure assembly for providing a low-pressure environment for the injured animal, a burning assembly used for injuring the animal by means of burning, a seawater soaking assembly used for soaking the injured animal in seawater, a photographing assembly used for high-speed photography, and a binding assembly used for fixing the animal during fragment injury, shock wave injury, burning injury and seawater soaking;

the fragment assembly includes a base, a compression chamber arranged on the base, and a fragment generator and a supercharger which are arranged at two ends of the compression chamber, the compression chamber being a closed housing, and openings being provided in two ends of the housing, wherein one opening in the openings is in communication with the fragment generator, and the other opening in the openings is in communication with the supercharger;

the shock wave assembly includes an injection pipe, a high-pressure chamber and an instant pressurization mechanism, a high-pressure cavity being provided in the high-pressure chamber and in communication with the instant pressurization mechanism by a high-pressure pipeline, one end of the injection pipe being in communication with the high-pressure cavity of the high-pressure chamber, the other end of the injection pipe extending close to an animal fixation position, and a high-pressure fracture film being arranged in the injection pipe in a sealed mode;

the low-temperature assembly includes a cooling mechanism used for reducing an air temperature and a first storage housing, the first storage housing being a hollow housing with an opening in a front side, a first cover body used for covering the opening being arranged on one side of the opening of the first storage housing by a hinge, and the first cover body being made of a transparent material;

the low-pressure assembly includes a second storage housing and a vacuum pump arranged on one side of the second storage housing, the input end of the vacuum pump being connected with an explosion-proof pipe pass through the second storage housing and extending into the second storage housing and a filtering mechanism for preventing hair from blocking the vacuum pump; wherein the second storage housing is a hollow housing with an opening in a front side, a second cover body used for covering the opening is arranged on one side of the opening of the second storage housing by a hinge, the second cover body is made of a transparent material, a barometer used for monitoring an air pressure value in the second storage housing is arranged at a top of the second storage housing, and an induction end at a bottom of the barometer passes through a side wall of the second storage housing and extends into the second storage housing;

the burning assembly includes an ignition mechanism used for ignition and an adjustment mechanism used for absorbing fuel moisture and avoiding burning death of the animal, the ignition mechanism comprising an inverted U-shaped pipe used for accommodating fuel, an air pump and a pulverized coal igniter, wherein two ends of the inverted U-shaped pipe extend to be provided with buffer housings in a communicating mode, one buffer housing is in communication with the air pump, and the other buffer housing is in communication with the pulverized coal igniter;

the seawater soaking assembly includes a third storage housing used for accommodating solvent, a liquid inlet pipe in communication with one side of the third storage housing, a liquid outlet pipe in communication with a bottom of the third storage housing, a one-way valve arranged on the liquid outlet pipe, a water storage tank used for accommodating the injured animal for seawater soaking, a water pump used for communicating the third storage housing and the water storage tank, and an acceleration mechanism used for accelerating a dissolution rate of solute in solvent;

the photographing assembly includes a high-speed camera, a telescopic mechanism used for adjusting a photographing angle of the high-speed camera and a weight increasing bottom plate, universal wheels being arranged at a bottom of the weight increasing bottom plate; wherein at least four high-speed cameras are arranged, a fixing base is arranged at a top of the weight increasing bottom plate, and the telescopic mechanism includes a first electric push rod arranged at a top of the fixing base, a telescopic member, a fixing plate and an extension mechanism used for extension and distance adjustment of the high-speed cameras; and the telescopic member includes a telescopic sleeve rod and a telescopic rod which are hinged to an output end of a top of the first electric push rod, the telescopic sleeve rod is of a hollow structure with an opening in one end, the telescopic rod extends into the telescopic sleeve rod from the opening and is adjusted to extend and retract, a limiting hole penetrating into a hollow interior of the telescopic sleeve rod is provided in a surface of the telescopic sleeve rod, at least two elastic limiting keys clamped into the limiting hole are arranged on the telescopic rod, and the telescopic rod extends and retracts on an inner side of the telescopic sleeve rod and is clamped to an inner side of the limiting hole by the elastic limiting key, such that the telescopic rod is fixed to the inner side of the telescopic sleeve rod.

In some embodiments, the fragment generator includes an energy accumulation pipe and a fragment generation mechanism detachably arranged at an end of the energy accumulation pipe, the fragment generation mechanism including a hollow sleeve body, a sheet arranged at an end of the sleeve body in a sealing manner and several fragments fixed in the sheet in a dispersed manner, wherein the sleeve body is fixedly connected to the energy accumulation pipe, the supercharger is a high-pressure air compressor, the high-pressure air compressor provides high-pressure air for the compression chamber, cracks are provided in a periphery of any of the fragments of the sheet, the sheet is broken at the cracks under the action of the high-pressure air, and then the fragments pop out of the sleeve body.

In some embodiments, the instant pressurization mechanism includes a housing, a sealing plate, a water inlet tank, a water inlet rod, a piston, a push rod and a water inlet driver, a high-temperature cavity accommodating a high-temperature medium being provided in the housing, the sealing plate being arranged above the high-temperature cavity in a liftable manner, the piston being arranged in the high-pressure cavity, one end of the push rod extending into the high-pressure cavity to be fixed to the piston, the other end of the push rod extending into the high-temperature cavity to be fixed to the sealing plate, the water inlet tank being provided below the housing, a water inlet hole being provided in the area, in the water inlet tank, of the housing, the water inlet rod being fixed to the water inlet tank by the water inlet driver in a liftable manner, and an end of the water inlet rod extending into the water inlet tank to seal the water inlet hole.

In some embodiments, the cooling mechanism includes a semiconductor chilling plate, a fixing housing for storing the semiconductor chilling plate, a heat dissipation copper pipe arranged at a heat dissipation end of the semiconductor chilling plate and a cold conduction block arranged at a chilling end of the semiconductor chilling plate, the fixing housing being of a hollow structure with openings in two sides, one side of the fixing housing penetrating the first storage housing and extending into the first storage housing, the other side of the fixing housing being retained outside the first storage housing, and the cold conduction block and the chilling end of the semiconductor chilling plate being located in the first storage housing.

In some embodiments, the filtering mechanism includes a sleeve which sleeves one side of an air inlet of the explosion-proof pipe and is used for primarily filtering hair, a non-woven fabric which is arranged on a cross section of one side of the air inlet of the explosion-proof pipe and is used for secondarily filtering the hair, and a locking member which is used for fixing the sleeve on the explosion-proof pipe, an airflow hole being provided in a surface of one side of the sleeve.

In some embodiments, the adjustment mechanism includes a semiconductor chilling plate, a heat dissipation copper plate arranged at a heat dissipation end of the semiconductor chilling plate, a cold conduction block arranged at a chilling end of the semiconductor chilling plate, and a spraying mechanism used for spraying low-temperature liquid water, one end of the heat dissipation copper plate penetrating the buffer housing adjacent to the pulverized coal igniter and extending into the buffer housing, a pressure reduction opening is provided in a portion, extending into the buffer housing, of the heat dissipation copper plate, and a caliber of the pressure reduction opening being gradually reduced from a fuel inlet end to a fuel outlet end.

In some embodiments, the acceleration mechanism includes a non-woven fabric bag arranged in the third storage housing and used for storing solute, an electric motor arranged at a bottom of the third storage housing and a rotary disc arranged at a top end in the third storage housing and connected with the non-woven fabric bag, a rotating shaft at an output end of a top of the electric motor penetrating the third storage housing and extending into the third storage housing to be connected to the non-woven fabric bag, and a bearing being arranged at a joint between the rotating shaft and the third storage housing, wherein an outer ring of the bearing is connected with an inner wall of the third storage housing, and an inner ring of the bearing is connected with the rotating shaft;

a salinometer is arranged at a top of the third storage housing, an induction end of a bottom of the salinometer penetrates the third storage housing and extends into the third storage housing, and support columns used for supporting the third storage housing are arranged on two sides of the third storage housing; and a circular channel extending into a hollow interior of the third storage housing is provided in the top of the third storage housing, feeding pipes are arranged at two ends of a top of the non-woven fabric bag, the tops of the feeding pipes passing through the circular channel and then penetrating out of the third storage housing, and the electric motor drives the non-woven bag to rotate by the rotating shaft, such that the feeding pipes rotate on an inner side of the annular channel.

In some embodiments, the fixing plate is fixedly connected with an end of the telescopic rod, at least four extension mechanisms are arranged, each extension mechanism includes a second electric push rod fixedly arranged on a front side of the fixing plate and an adjustment plate hinged to an output end of the second electric push rod, and the at least four cameras are fixedly arranged on front sides of the at least four adjustment plates respectively for multi-angle photographing.

In some embodiments, the binding assembly includes a third electric push rod and an L-shaped fixing plate arranged at an output end of a top of the third electric push rod, and the binding assembly further includes two arc-shaped plates used for clamping an injured animal body, a slide groove channel provided in a surface of one side of the L-shaped fixing plate and a slide groove block arranged on one side of each arc-shaped plate in the two arc-shaped plates, the slide groove channel being of a hollow structure with an opening in a surface, the slide groove block being embedded into a hollow inner side of the slide groove channel by the opening of the slide groove channel to restrictively slide, and the slide groove block being capable of being fixed to the hollow inner side of the slide groove channel by a locking member.

In some embodiments, the universal platform for accurately injuring animal under multi-condition and multi-simulation-environment further includes a protective cover, the protective cover being a cover body with openings at two ends, one opening of the cover body being detachably connected with the sleeve body, the other opening of the cover body covering an injured part, and the cover body being made of a multi-layer structure, wherein the multi-layer structure at least includes a framework layer, a heat absorption layer stacked outside the framework layer and an energy absorption layer arranged outside the heat absorption layer in a sealed mode, the framework layer being of a net structure made of metal wires, the heat absorption layer being of a porous structure made of heat absorption materials, and the energy absorption layer being a membrane made of elastic materials, wherein a heat insulation space is arranged between the membrane and the heat absorption layer in a sealed mode, and a plurality of reset springs are arranged in the heat insulation space.

In some embodiments, the universal platform for accurately injuring animal under multi-condition and multi-simulation-environment further includes an accommodation assembly arranged in the first storage housing or the second storage housing and used for accommodating an animal, the accommodation assembly including an accommodation housing arranged in the first storage housing or the second storage housing and used for accommodating an injured animal, a slide wheel arranged at a bottom of the accommodation housing, and a slide groove channel provided in a bottom end in the first storage housing or the second storage housing and used for restrictive sliding of the slide wheel, wherein the accommodation housing is of a recessed groove structure with a middle of a top end recessed, a sleeve base is arranged at a bottom of the accommodation housing, the sleeve base is of a hollow structure with openings in two ends, internal threads are arranged on an inner wall of the sleeve base in a surrounding mode, and an opening at a bottom of the sleeve base is in threaded connection to a storage pipe used for accommodating blood.

In some embodiments, the locking member includes an elastic limiting key arranged at an outer edge of a side of an air inlet of the explosion-proof pipe and a limiting hole provided in the sleeve and clamped to the elastic limiting key, one side, sleeving the air inlet of the anti-explosion pipe, of the sleeve being clamped to an inner side of the limiting hole by means of the elastic limiting key, such that the sleeve is fixed to the anti-explosion pipe.

In some embodiments, the spraying mechanism includes a sleeve arranged at one end of the cold conduction block in a sleeving manner, a water storage housing used for containing stored water, and a water pump used for pumping cooled liquid water in the water storage housing to a spray head.

In some embodiments, the locking member includes elastic limiting keys arranged at a top and a bottom of the slide groove block and at least two limiting holes which are provided on top and bottom surfaces of the slide groove channel and are clamped to the elastic limiting keys, the slide groove block sliding on an inner side of the slide groove channel restrictively and being clamped to an inner side of the limiting hole by the elastic limiting key, such that the slide groove block is fixed to the hollow inner side of the slide groove channel.

Some embodiments of the present disclosure have the beneficial effects:

1. High-pressure air is provided for the compression chamber by means of the supercharger to make the compression chamber have a certain high-pressure environment and make the pressure further increased, then the cracks are torn off, the fragments fly out and are safely generated, there is no need to generate fragment by means of cannonball explosion, and accordingly, a test site is remarkably reduced, and the test cost is remarkably reduced.

2. The pressure of the compression chamber only needs to reach a working pressure in a certain instant and does not need to be continuously stabilized at the working pressure, which reduces a safety requirement on equipment.

3. A protective space is defined between an injuring end and a protective end by the protective cover, when shock waves occur, the heat absorption layer absorbs heat, the shock waves enter the energy absorption layer by the porous structure, due to elastic expansion of the energy absorption layer, energy is released, and shock wave energy is reduced, which avoids damage to the external environment and workers, and use is safer.

4. High-pressure air is provided for the high-pressure chamber by the external high-pressure generator, such that the high-pressure chamber has an environment with a certain high pressure which is not a working pressure and much smaller than an injuring pressure, which may protect an apparatus.

5. Water is added into a high-temperature medium, and is rapidly vaporized to form explosion, resulting in violent moving of the push rod, then the high-pressure film is broken, and strong directional shock waves are formed to cause muscle or bone injury to an animal.

6. By means of cooperative use of the accommodation housing, the slide wheel and the slide groove channel, an experimenter may place an animal on the top of the accommodation housing and push the animal into and out of the first storage housing, after an experiment is completed, only the accommodation housing needs to be cleaned, and the interior of the first storage housing does not need to be integrally cleaned, which reducing unnecessary workloads of the experimenter.

7. By means of cooperative use of the filtering mechanism sleeve, the locking member and the non-woven fabric, when animal hair moves towards the anti-explosion pipe due to work of the vacuum pump, the animal hair is filtered and intercepted by the sleeve and the non-woven fabric, and the situation that the vacuum pump is blocked due to the fact that the animal hair is sucked into the vacuum pump, and consequently smooth proceeding of scientific experiments is influenced is avoided.

8. By means of cooperative use of the inverted U-shaped pipe, the air pump, the pulverized coal igniter and the buffer housing, when an animal needs to be injured by means of burning, the fuel is blown to the pulverized coal igniter by the air pump for ignition, the brand-new inverted U-shaped pipe design is employed, serious burning of the animal due to the fact that the fuel is out of control and used too much is avoided, and on the other hand, an air pump blowing mode is employed, a fuel feeding mode is simplified, gas is used as a medium, the safety of the fuel in the feeding process is improved, further, compared with a traditional ignition mode, the technical solution of some embodiments of the disclosure avoids the problems of fuel gas leakage and high dangerousness, and the problem that the accuracy and the reliability of scientific experiments are influenced due to the fact that a burn area of the animal is possibly too large is directly solved.

9. By means of cooperative use of the semiconductor chilling plate, the heat dissipation copper plate, the cold conduction block and the spraying mechanism, on one hand, the purpose of absorbing moisture doped in the fuel is achieved, the combustion efficiency of the fuel is improved, and on the other hand, when an animal burn area is too large due to improper operation of an experimenter or influences of other external factors, the spraying mechanism, the semiconductor chilling plate and the cold conducting block are used in a matching manner in time, low-temperature liquid is sprayed out to cool and extinguish an animal, and accordingly, the safety of a scientific experiment is improved, and the situation that the animal is burnt to be killed is effectively avoided.

10. By means of cooperative use of the third electric push rod, the L-shaped fixing plate, the arc-shaped plates, the slide groove channel, the slide groove block and the locking member, an experimenter may slide the slide groove block on the inner side of the slide groove channel in advance so as to drive the two arc-shaped plates to clamp an injured animal body, then the slide groove block is fixed by means of the locking member, and then by utilizing a lifting function of the third electric push rod, an animal is driven by the L-shaped fixing plate to perform injuring operation, thereby effectively solving the problem that the animal goes crazy and attacks the experimenter due to injury pain.

11. By means of cooperative use of the non-woven fabric bag, the electric motor and the rotary disc, solute is placed in the non-woven fabric bag, then the electric motor is used for driving the non-woven fabric bag to rotate, meanwhile, the non-woven fabric bag is prevented from being clamped and locked by means of the mobility of the rotary disc, at the moment, solute makes contact with a solvent due to rotation of the non-woven fabric bag, since the solvent is not stirred, a rotation rate of the solvent is relatively lower than that of the solute, then the relative acting force between the solute and the solvent is increased to a certain extent, thereby further increasing the dissolution rate of the solute in the solvent, and the seawater preparation efficiency is improved; and compared with a traditional seawater preparation device, the technical solution of the disclosure gets rid of a stirring and mixing mode of the solvent, and employs a mode of rotationally stirring the solute to increase the relative acting force between the solute and the solvent, thereby achieving the purpose of accelerating the solute to dissolve in the solvent.

12. By means of cooperative use of the first electric push rod, the fixing plate, the telescopic sleeve rod, the telescopic rod, the elastic limiting key, the limiting hole, the second electric push rod and the adjustment plate, a user may selectively adjust a height of the first electric push rod and a length between the telescopic sleeve rod and the telescopic rod according to the real-time condition of the field environment, the at least four high-speed cameras are skillfully staring at an animal in the burn process according to hinged connection between the second electric push rod and the adjustment plate, multi-angle high-efficiency photographing is achieved, and the problem of photographing blind spots is avoided; and in addition, according to the technical solution of the disclosure, a free moving function of the universal wheel is utilized, the user can conveniently use and move the device, and moreover, an adjustable photographing is carried out at a periphery of the burnt animal, therefore the safety accident that when the user holds the device, the burnt animal attacks the user is avoided.

In short, the technical solution of some embodiments of the disclosure provides, by means of innovative design, an animal injuring platform which is compact in structure and complete in function, multiple selectable injuring modes and natural environments are provided for scientific research workers, and the platform provides help for providing various experiment conditions, reducing the experiment workload, improving the working efficiency, reducing the experiment cost and improving the human body injury research level, and ensures the accuracy of an experiment result by means of the whole-process high-speed photographing function.

Other advantages, objectives, and features of the present disclosure will be set forth in the following description, and in part will be apparent to those skilled in the art on the basis of the investigation into the following, or may be taught from the practice of the present disclosure. Objectives and other advantages of the present disclosure may be achieved and attained by means of the following description.

Figure 1:
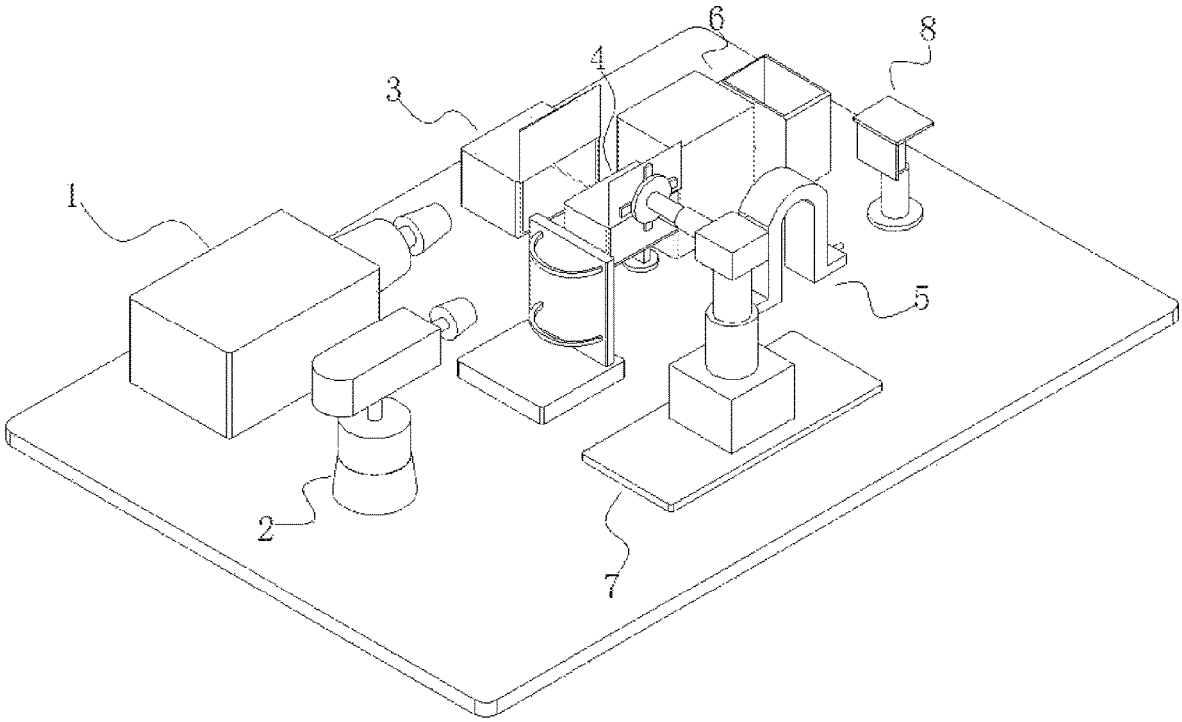
FIG. 1 is an overall layout of an embodiment of the present disclosure.
Figure 2:
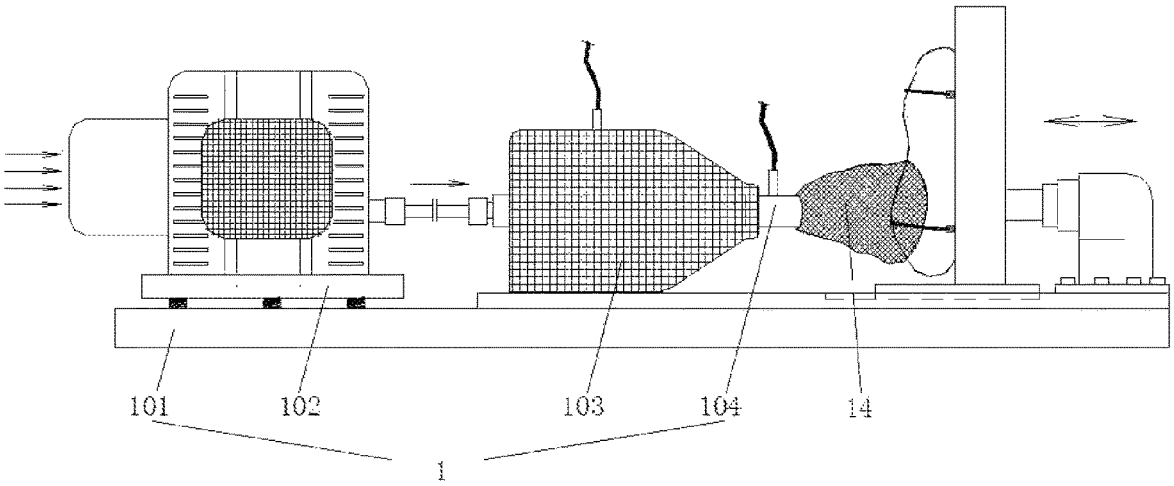
FIG. 2 is a partial schematic diagram of a fragment assembly of an embodiment of the present disclosure.
Figure 3:
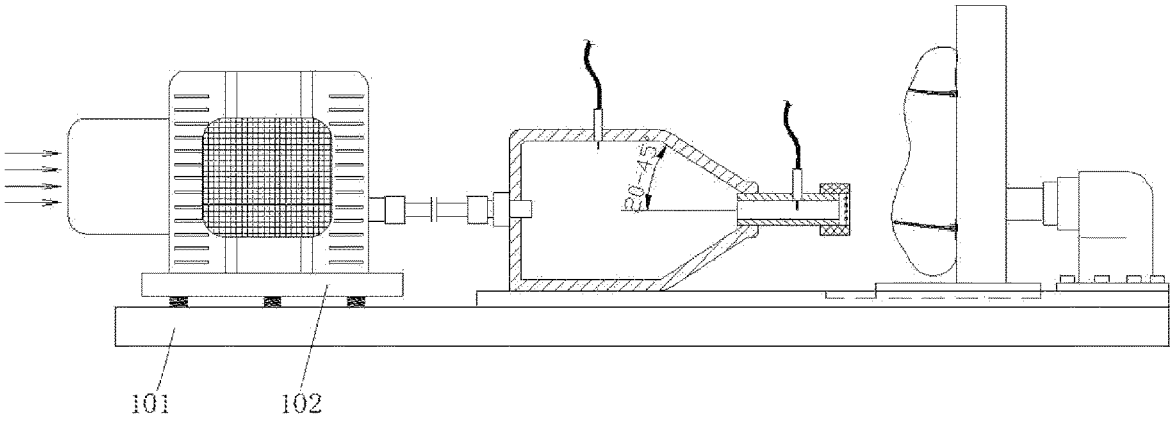
FIG. 3 is a structural schematic diagram of the fragment assembly without a protective cover, of an embodiment of the present disclosure.
Figure 4:
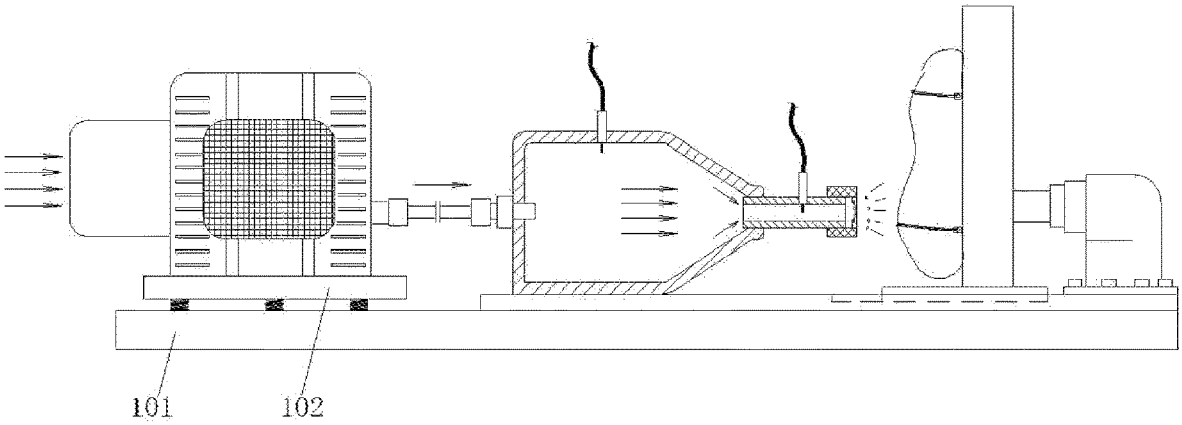
FIG. 4 is a schematic diagram of a working state of the fragment assembly of an embodiment of the present disclosure.
Figure 5:
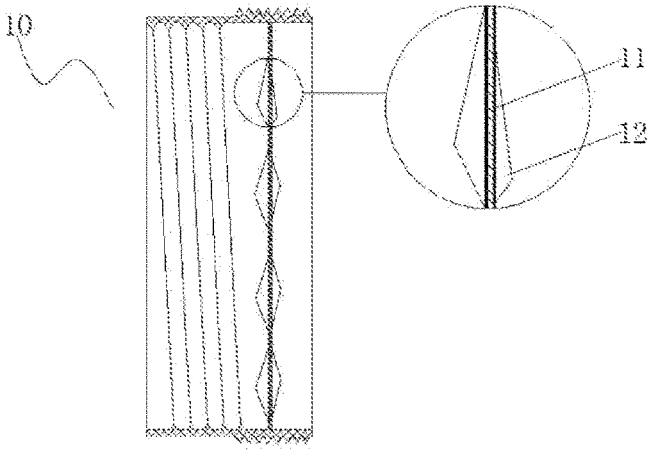
FIG. 5 is a partial schematic diagram of a sleeve body of an embodiment of the present disclosure.
Figure 6:
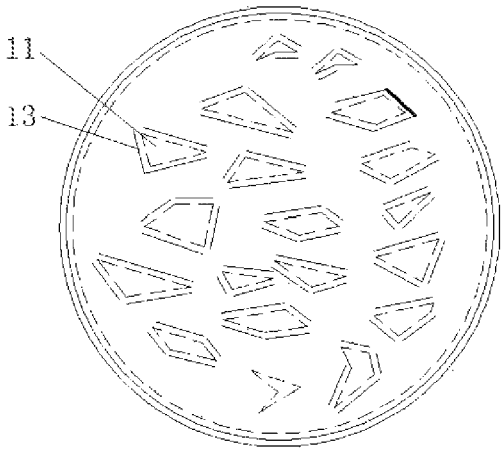
FIG. 6 is a side view of the sleeve body of an embodiment of the present disclosure.

In the figure: 1. fragment assembly; 101. base; 102. supercharger; 103. compression chamber; 104. fragment generator; 2. shock wave assembly; 201. injection pipe; 202. high-pressure chamber; 203. instant pressurization mechanism; 3. low-temperature assembly; 301. first storage housing; 4. low-pressure assembly; 401. second storage housing; 5. burning assembly; 6. seawater soaking assembly; 601. third storage housing; 602. water pump; 603. water storage tank; 7. photographing assembly; 701. high-speed camera; 702. weight increasing bottom plate; 8. binding assembly; 801. third electric push rod; 802. L-shaped fixing plate; 803. slide groove channel; 804. arc-shaped plate; 805. slide groove block; 9. energy accumulation pipe; 10. sleeve body; 11. sheet; 12. fragment; 13. crack; 14. protective cover; 15. framework layer; 16. heat absorption layer; 17. energy absorption layer; 18. reset spring; 19. heat insulation space; 20. high-pressure fracture film; 21. housing; 22. sealing plate; 23. water inlet tank; 24. water inlet rod; 25. piston; 26. push rod; 27. water inlet driver; 28. first cover body; 29. cooling mechanism; 2901. fixing housing; 2902. heat dissipation copper pipe; 2903. cold conduction block; 2904. semiconductor chilling plate; 30. second cover body; 31. sleeve; 32. accommodation assembly; 3201. accommodation housing; 3202. slide wheel; 3203. slide groove channel; 33. sleeve base; 34. storage pipe; 35. ignition mechanism; 3501. inverted U-shaped pipe; 3502. air pump; 3503. pulverized coal igniter; 36. buffer housing; 37. adjustment mechanism; 3701. heat dissipation copper plate; 3702. semiconductor chilling plate; 3703. cold conduction block; 38. spraying mechanism; 3801. water pump; 3802. water storage housing; 3803. sleeve; 39. acceleration mechanism; 3901. electric motor; 3902. non-woven fabric bag; 3903. rotary disc; 40, fixing base; 41. telescopic mechanism; 4101. first electric push rod; 4102. fixing plate; 42. telescopic member; 4201. telescopic sleeve rod; 4202. telescopic rod; 43. extension mechanism; 4301. second electric push rod; 4302. adjustment plate.

DETAILED DESCRIPTION OF THE EMBODIMENTS

For making the objectives, technical solutions and advantages of embodiments of the present disclosure more obvious, the technical solutions of the present disclosure will be clearly and completely described below in conjunction with the accompanying drawings in the embodiments of the present disclosure, and obviously, the described embodiments are some, rather than all of the embodiments of the present disclosure. The assemblies of the embodiments of the present disclosure, generally described and illustrated in the accompanying drawings herein, may be arranged and designed in a variety of different configurations.

Therefore, the following detailed description of the embodiments of the present disclosure provided in the accompanying drawings is not intended to limit the scope of the claimed disclosure, but is merely representative of selected embodiments of the present disclosure. Based on the embodiments of the present disclosure, other various embodiments obtained by those of ordinary skill in the art without making creative efforts fall within the scope of protection of the present disclosure.

It should be noted that like numerals and letters denote like items in the following accompanying drawings, and therefore, once an item is defined in one accompanying drawing, it need not be further defined and explained in the subsequent accompanying drawings.

In the above description of the present disclosure, it is to be noted that the orientation or positional relation indicated by terms "one side", "the other side", etc. is based on the orientation or positional relation shown in the accompanying drawings, or the orientation or positional relation of a product conventionally placed during use, merely for ease of description and simplification of the description of the present disclosure, and not to indicate or imply that the referenced device or element must have a particular orientation and be constructed and operative in a particular orientation, and thus may not be construed as a limitation on the present disclosure. Moreover, the terms "first", "second", etc. are used merely to distinguish between descriptions and may not be understood as indication or implication of relative importance.

Furthermore, terms "identical", etc. do not denote that the components are required to be absolutely identical, but that there may be minor differences. The term "perpendicular" merely refers to the positional relation between components being more perpendicular relative to "parallel", and does not mean that the structure must be completely perpendicular, but may be slightly inclined.

With reference to FIGS. 1-34, some embodiments of the present disclosure provide a technical solution: an universal platform for accurately injuring an animal under multi-condition and multi-simulation-environment includes a fragment assembly 1 used for injuring the animal by means of a fragment, a shock wave assembly 2 used for injuring the animal by means of shock waves, a low-temperature assembly 3 for providing a low-temperature environment for the injured animal, a low-pressure assembly 4 for providing a low-pressure environment for the injured animal, a burning assembly 5 used for injuring the animal by means of burning, a seawater soaking assembly 6 used for soaking the injured animal in seawater, a photographing assembly 7 used for high-speed photography, and a binding assembly 8 used for fixing the animal during fragment injury, shock wave injury, burning injury and seawater soaking.

In some embodiments of the present disclosure, as shown in FIGS. 1-6 and FIG. 9, the fragment assembly 1 includes a base 101, a compression chamber 103 arranged on the base, and a fragment generator 104 and a supercharger 102 which are arranged at two ends of the compression chamber, the compression chamber is a closed housing, and openings are provided in two ends of the housing, wherein one opening in the openings is in communication with the fragment generator, and the other opening in the openings is in communication with the supercharger 102;

the fragment generator includes an energy accumulation pipe 9 and a fragment generation mechanism detachably arranged at an end of the energy accumulation pipe, the fragment generation mechanism includes a hollow sleeve body 10, a sheet 11 arranged at an end of the sleeve body in a sealing manner and several fragments 12 fixed in the sheet 11 in a dispersed manner;

a connection structure is arranged between the sleeve body 10 and the energy accumulation pipe; and the supercharger is a high-pressure air compressor, the high-pressure air compressor provides high-pressure air for the compression chamber, cracks 13 are provided in a periphery of any fragment of the sheet, the sheet is broken at the cracks under the action of the high-pressure air, and then the fragments pop out of the sleeve body.

The energy accumulation pipe is used for accumulating high-pressure air energy to break through the sheet, so as to make the fragments carry out injuring action. The energy accumulation pipe is made of metal materials, for example, cast iron, steel, magnesium-aluminum alloy, etc. and has high strength, wherein the tensile strength thereof is at least larger than strength generated when airflow acts on the energy accumulation pipe; the sleeve body is made of metal materials, for example, cast iron, steel, magnesium-aluminum alloy, etc. and has high strength, wherein the tensile strength thereof is at least larger than the strength generated when airflow acts on the sleeve body; the sheet is arranged at an end part of the sleeve body in a sealing manner to block a sleeve body flowing channel, so as to form a sealing and closed space in the sleeve body; and the several fragments are fixed in the sheet in a dispersed manner, meanwhile, an end, away from the sheet, of the sleeve body is provided with the connection structure, the connection structure is used for being connected to an external air source, the connection structure is not limited in form and may be a clamping structure or a threaded structure or another structure, the embodiment is provided with an internal thread, the energy accumulation pipe is provided with an external thread screwed to the internal thread of the sleeve body, connection is achieved by screwing the sleeve body into the energy accumulation pipe, connection is easy and convenient, and meanwhile, for preventing air leakage, the internal thread is arranged to be a 55-degree sealing pipe thread.

For ejecting the fragment, a crack 13 is provided in the periphery of the fragment, and the crack is set to be cracked at a certain specific pressure value. The supercharger is a high-pressure air compressor, the high-pressure air compressor provides high-pressure air for the compression chamber, the sheet is broken at the cracks under the action of the high-pressure air, and then the fragments pop out of the sleeve body.

In some embodiments, the protective cover is a cover body with openings at two ends, the two openings are located at a connection end and a protective end separately, under the normal condition, the opening of the protective end is larger than that of the connection end so as to conveniently protect an injured part of an animal, the connection end is provided with a connector, the connector is provided with an internal thread I, and the sleeve body is provided with an external thread I matching the internal thread I so as to achieve threaded connection, which is detached or installed at any time and is convenient to use. The cover body is of a multi-layer structure including a framework layer, a heat absorption layer and an energy absorption layer, wherein the framework layer, the heat absorption layer and the energy absorption layer are sequentially stacked from inside to outside, the framework layer is of a net-shaped structure made of metal wires, the metal wires are iron wires or steel wires or copper wires, etc., which supports the protective device, and then a protective space is defined between the injuring end and the protective end for facilitating injuring operation; the heat absorption layer is of a porous structure made of a heat absorption material, on one hand, a certain amount of heat is absorbed, and on the other hand, impact energy is transmitted to the energy absorption layer by means of the porous structure; and the energy absorption layer is a membrane made of an elastic material, for example, vulcanized rubber serves as the elastic material, and when impact waves impact, the size expands, a large amount of energy is absorbed, and the damage level to the external environment is reduced.

Figure 10:
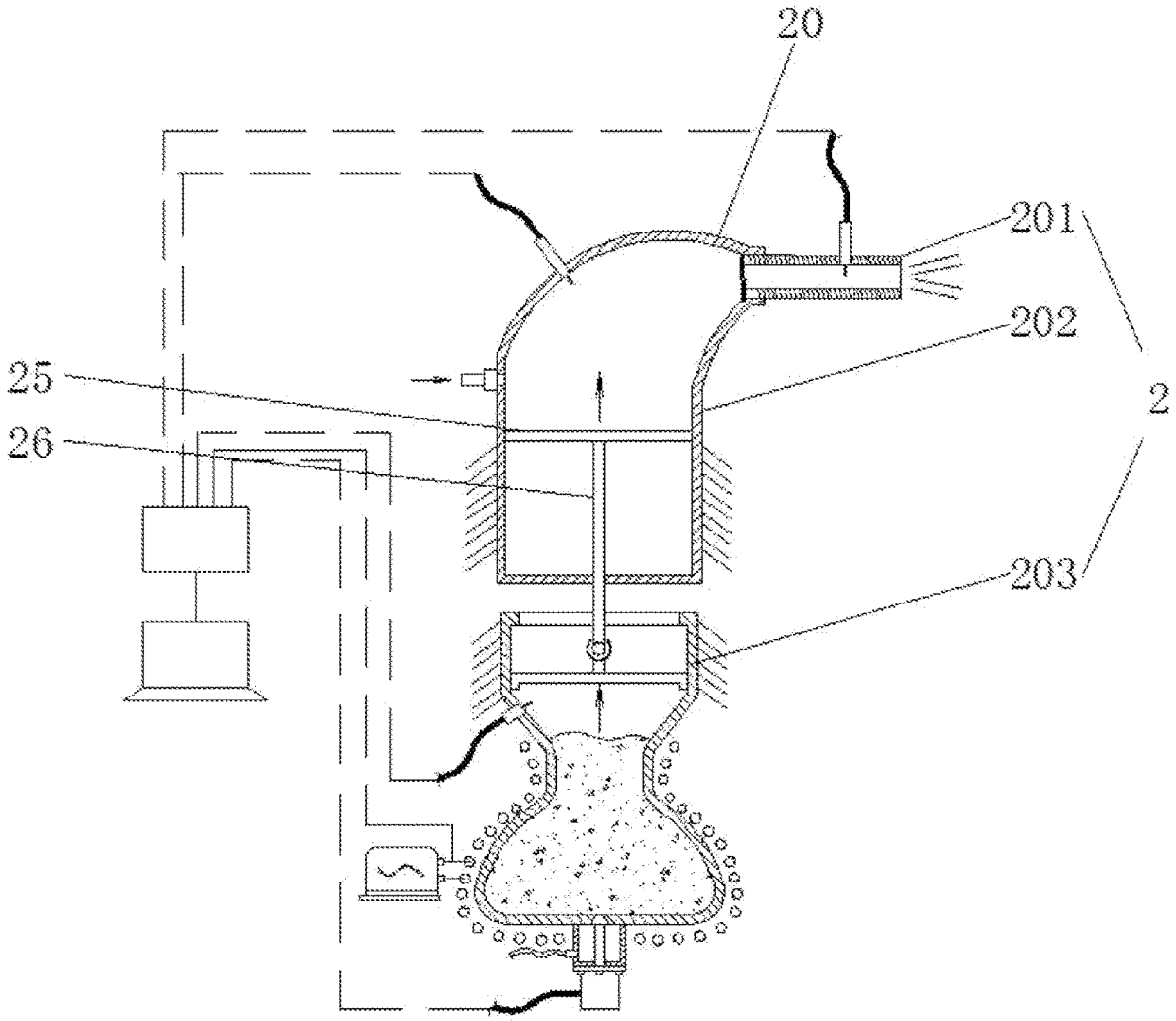
FIG. 10 is a partial schematic diagram of a shock wave assembly of an embodiment of the present disclosure.
Figure 11:
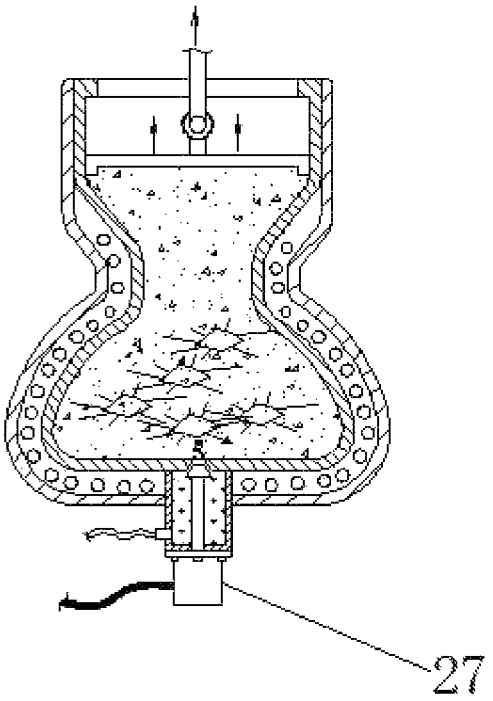
FIG. 11 is a working state diagram of an instant pressurization mechanism of an embodiment of the present disclosure.
Figure 12:
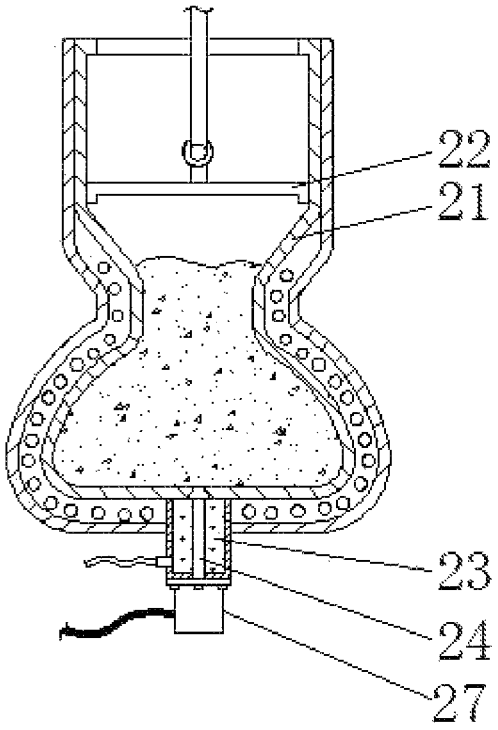
FIG. 12 is a structural schematic diagram of the instant pressurization mechanism of an embodiment of the present disclosure.
Figure 13:
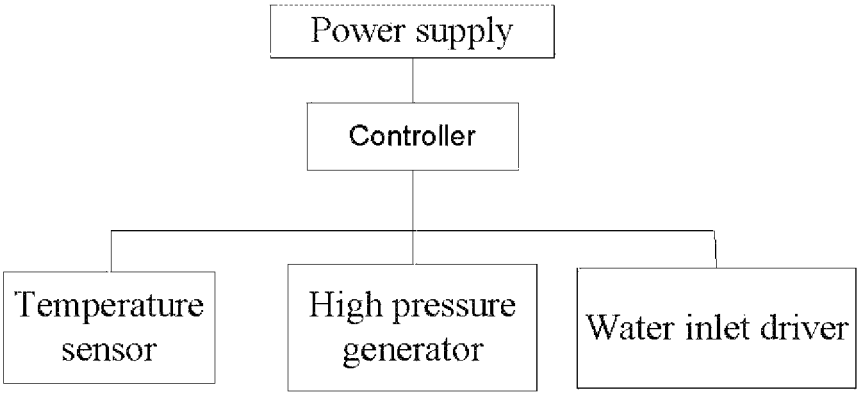
FIG. 13 is a circuit schematic diagram of the shock wave assembly of an embodiment of the present disclosure.
Figure 14:
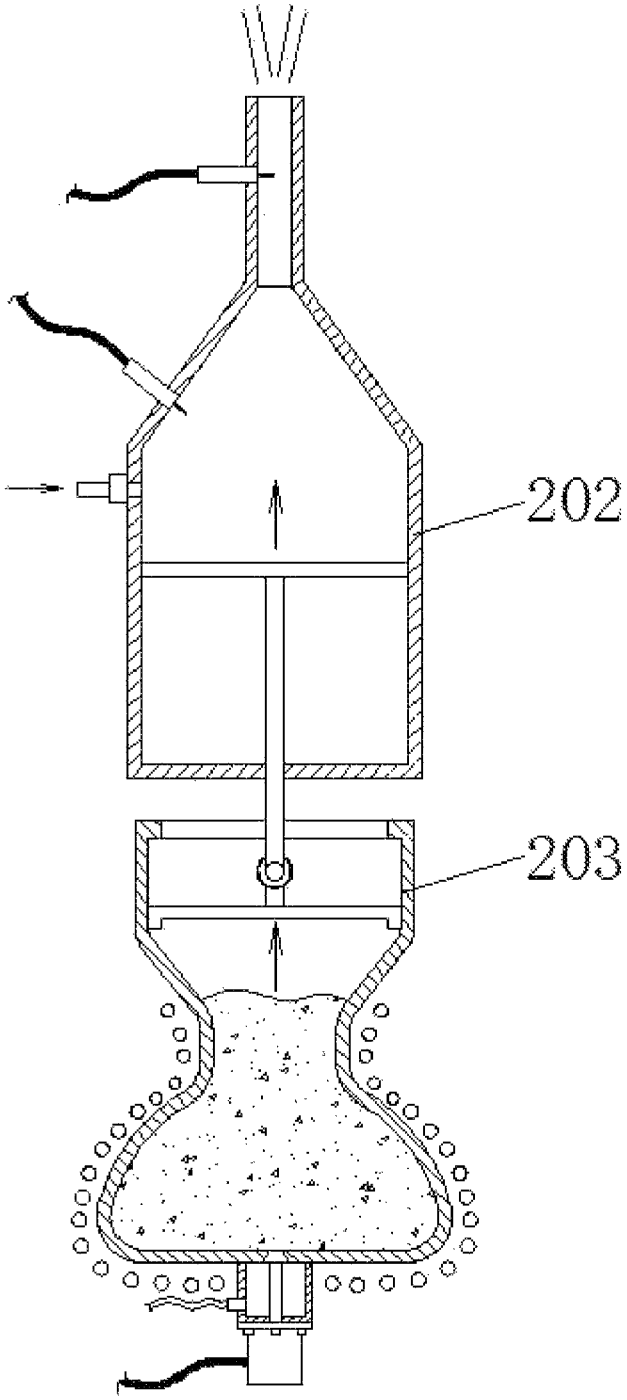
FIG. 14 is a schematic diagram of an injection pipe, when set upwards, of an embodiment of the present disclosure.
Figure 15:
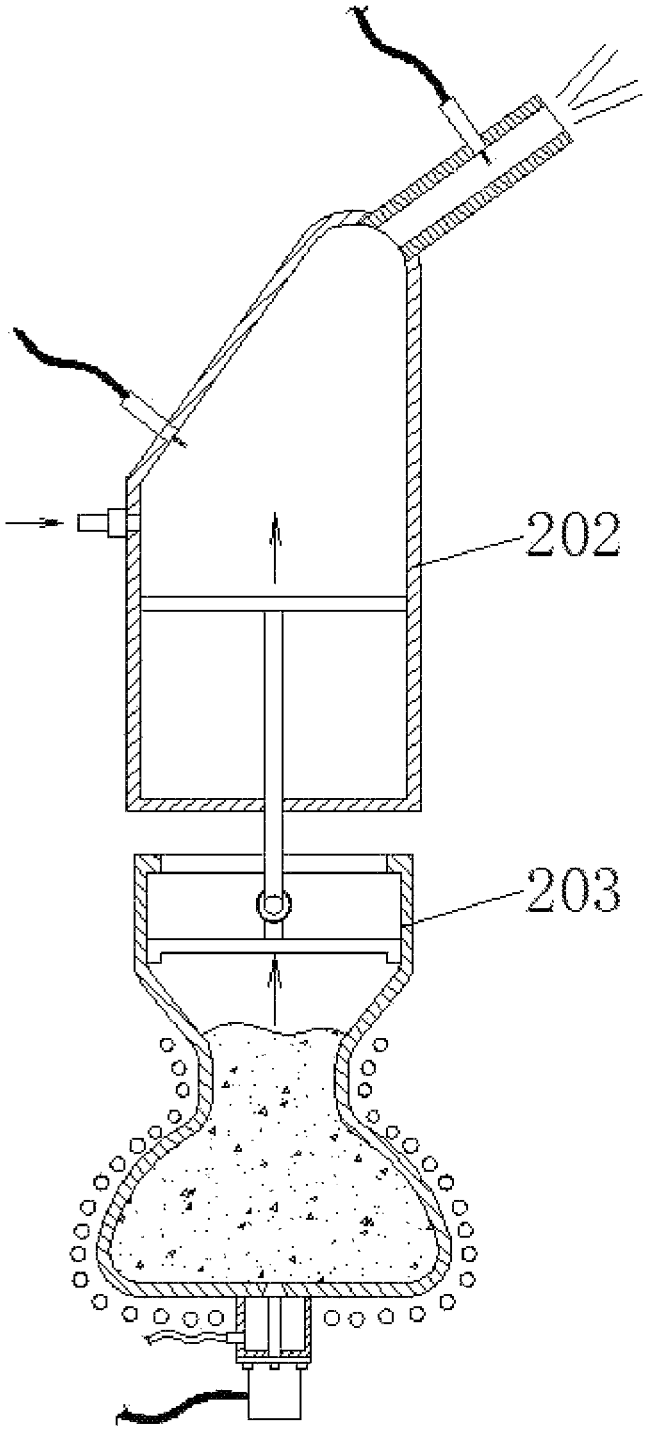
FIG. 15 is a schematic diagram of the injection pipe, when set towards an upper right direction, of the present disclosure.
Figure 16:
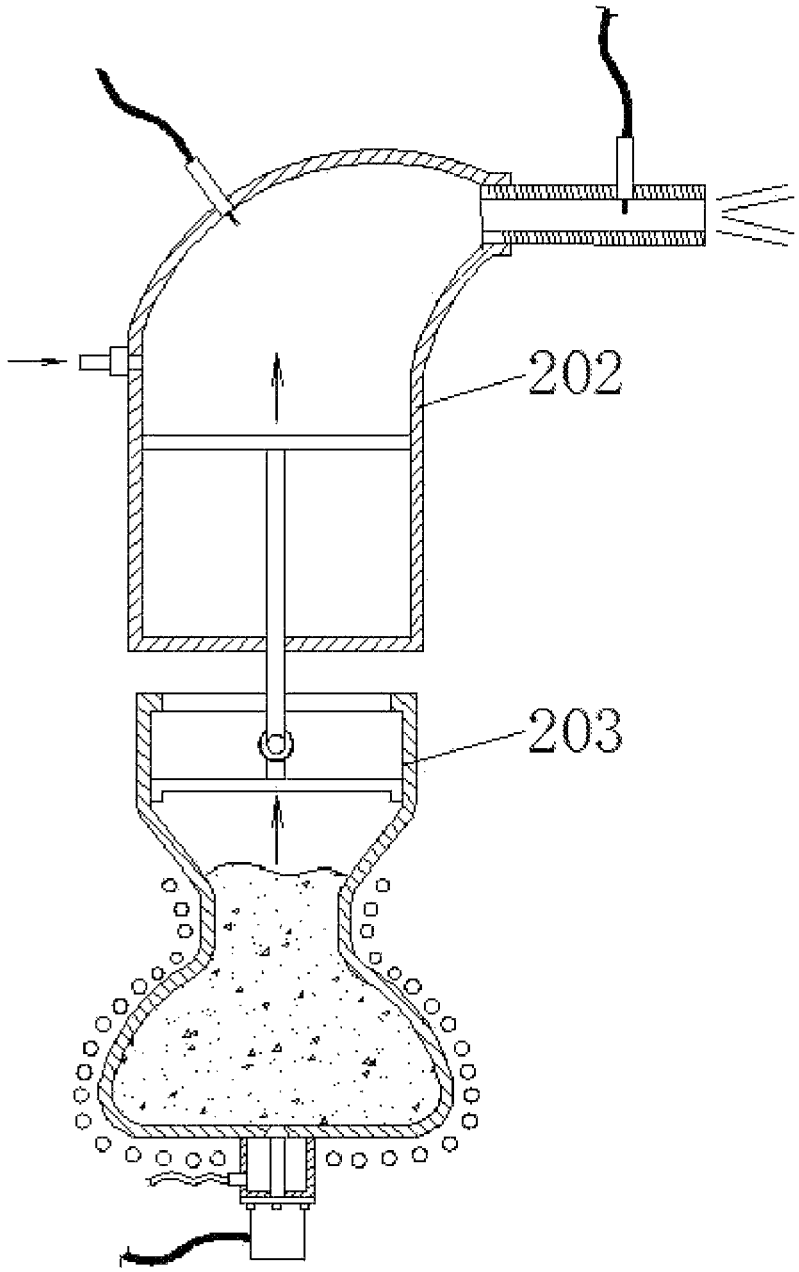
FIG. 16 is a schematic diagram of the injection pipe, when set rightwards, of the present disclosure.
Figure 17:
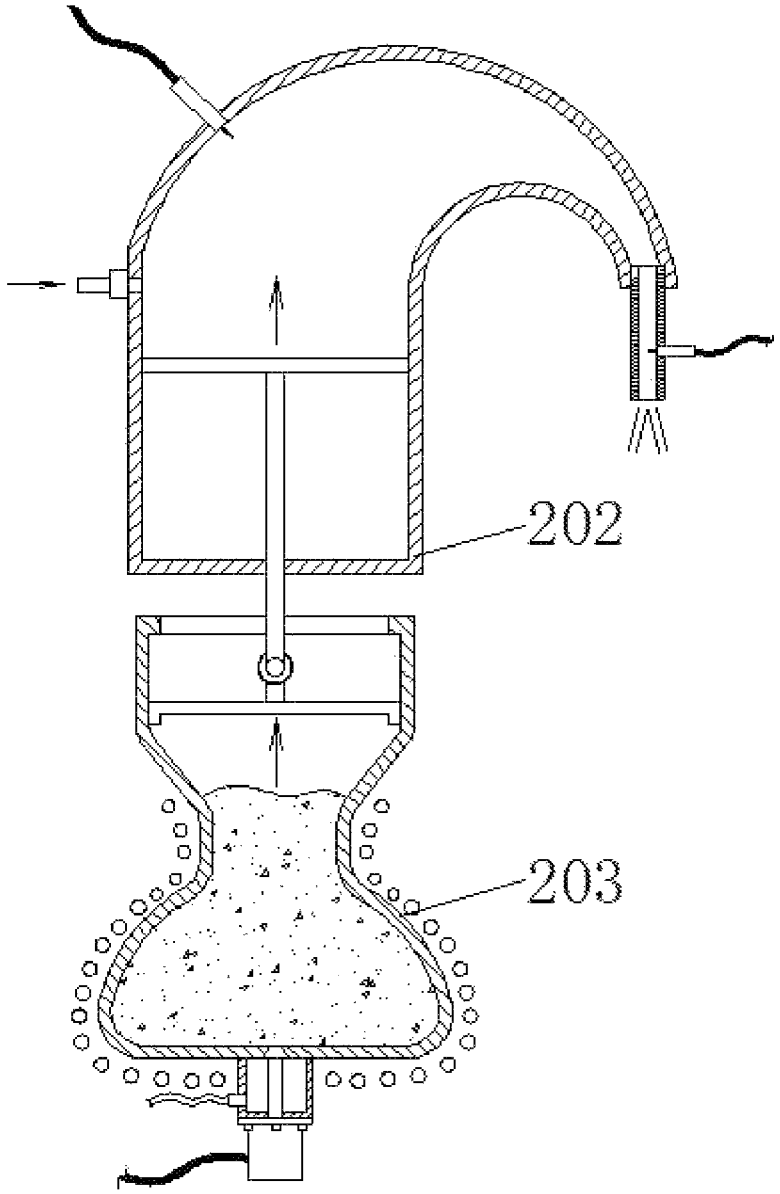
FIG. 17 is a schematic diagram of the injection pipe, when set towards a lower right direction, of the present disclosure.

In some embodiments of the present disclosure, as shown in FIGS. 10-12, the shock wave assembly 2 includes an injection pipe 201, a high-pressure chamber 202 and an instant pressurization mechanism 203, a high-pressure cavity is provided in the high-pressure chamber 202 and in communication with an external high pressure generator by a high-pressure pipeline, one end of the injection pipe is in communication with the high-pressure cavity of the high-pressure chamber, the other end thereof extends close to an animal fixation position, and a high-pressure fracture film 20 is arranged in the injection pipe in a sealed mode, the instant pressurization mechanism 203 includes a housing 21, a sealing plate 22, a water inlet tank 23, a water inlet rod 24, a piston 25, a push rod 26 and a water inlet driver 27, a high-temperature cavity accommodating a high-temperature medium is provided in the housing, the sealing plate is arranged above the high-temperature cavity in a liftable manner, the piston is arranged in the high-pressure cavity, one end of the push rod extends into the high-pressure cavity to be fixed to the piston, the other end thereof extends into the high-temperature cavity to be fixed to the sealing plate, the water inlet tank is provided below the housing, a water inlet hole is provided in the area, corresponding to the water inlet tank, of the housing, the water inlet rod is fixed to the water inlet tank by means of the water inlet driver in a liftable manner, and an end of the water inlet rod extends into the water inlet tank to seal the water inlet hole.

The high-pressure cavity is in communication with the external high pressure generator (not shown) by means of the high-pressure pipeline, the high pressure generator may be an air compressor or a high-pressure air pump, so as to conveniently provide pressure air for the high-pressure chamber to maintain a constant pressure value, one end of the injection pipe is in communication with the high-pressure cavity of the high-pressure chamber, the other end thereof extends close to the animal fixing position, so as to conveniently injure the animal by means of shock, the high-pressure fracture film is arranged in the injection pipe in a sealed mode, the high-pressure fracture film plays a role in sealing the high-pressure chamber during a non-work state, the high-pressure fracture film is a plastic film and is made of a plastic material or a metal material, multiple fracture marks are arranged on a film body, and accordingly, when the pressure in the high-pressure chamber is sharply increased, the high-pressure fracture film is instantly crushed along the fracture marks, and high-pressure air rushes out of the high-pressure chamber; and the instant pressurization mechanism includes a housing, a sealing plate, a water inlet tank, a water inlet rod, a piston, a push rod and a water inlet driver, a high-temperature cavity accommodating a high-temperature medium is provided in the housing, in an exemplary embodiment, the high-temperature medium is metal with the melting point of 300° C. or below, and certainly, may also be metal with the melting point of 300° C. or above. The metal with the melting point of 300° C. or below may be tin, bismuth, polonium or other low-melting-point alloy; and the sealing plate is arranged above the high-temperature cavity, and a certain gap is provided between the sealing plate and an inner wall of the high-temperature cavity, such that the sealing plate freely slides along the inner wall of the high-temperature cavity to go up and down under the impact of air pressure, meanwhile, the piston is arranged in the high-pressure cavity, one end of the push rod extends into the high-pressure cavity to be fixed to the piston, the other end thereof extends into the high-temperature cavity to be fixed to the sealing plate, the water inlet tank is provided below the housing, a water inlet hole is provided in the area, in the water inlet tank, of the housing, the water inlet rod is fixed to the water inlet tank by means of the water inlet driver in a liftable manner, and an end of the water inlet rod extends into the water inlet tank to seal the water inlet hole.

Under normal conditions, the end of the water inlet rod seals the water inlet hole to prevent water in the water inlet tank from entering the high-temperature cavity, during working, the water inlet driver is retracted to withdraw the water inlet rod from the water inlet hole, cooling water enters the high-temperature cavity to be rapidly vaporized and exploded, the high-temperature medium violently impacts the sealing plate, the sealing plate pushes the push rod and the piston to compress the high-pressure chamber, then the air may reach the working pressure in a short time, and through rational design and test, the high-pressure fracture film is rightly crushed, such that the high-pressure air rushes out of the high-pressure chamber and the injection pipe to injure the animal.

The working pressure is set as needed, generally, the working pressure is about 18 MPa-22 MPa, and similarly, the fracture pressure of the high-pressure fracture film is also about 18 MPa-22 MPa.

The water inlet tank is in communication with an external water source by means of the water inlet pipe so as to provide enough water and keep certain water pressure, and when the water inlet rod is opened, the water may enter the high-temperature cavity from the water inlet hole.

Figure 18:
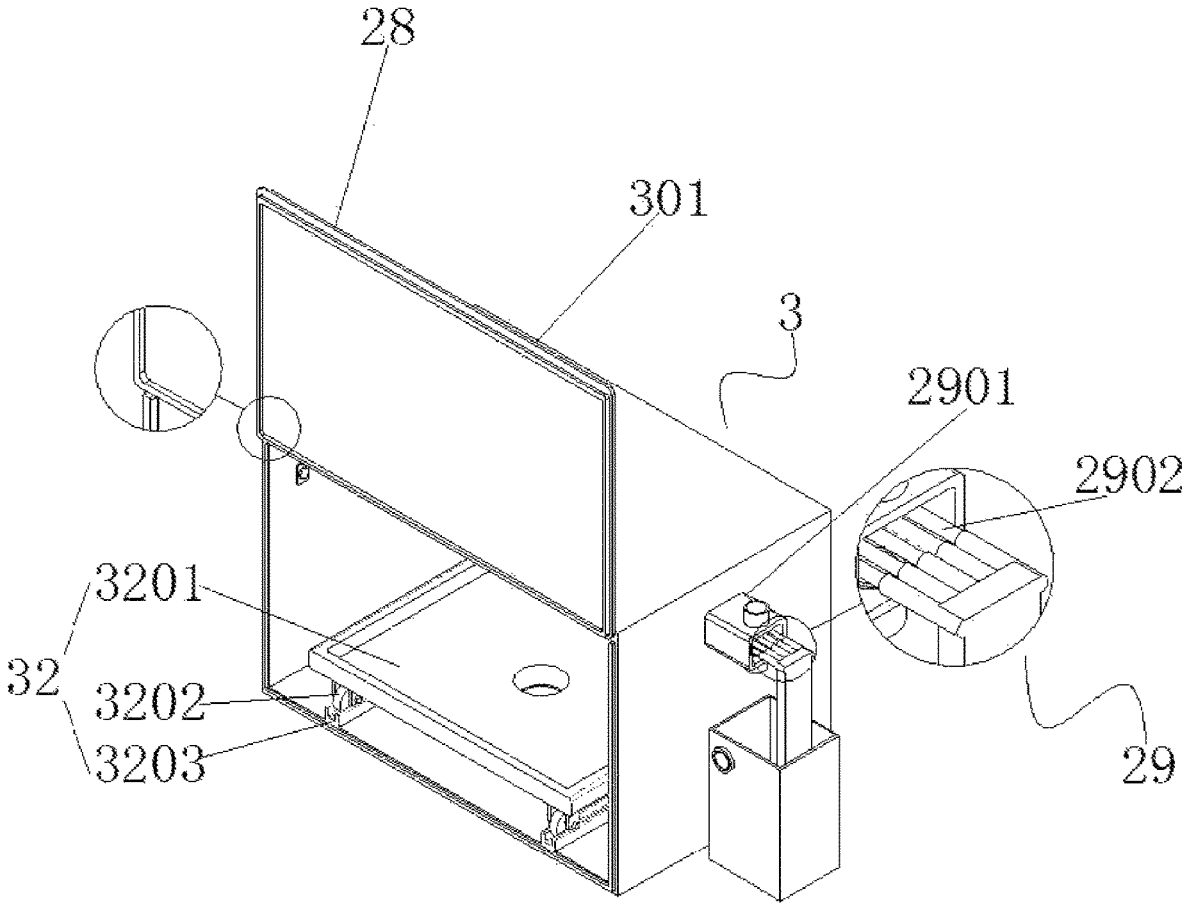
FIG. 18 is a partial schematic diagram of a low-temperature assembly of an embodiment of the present disclosure.
Figure 19:
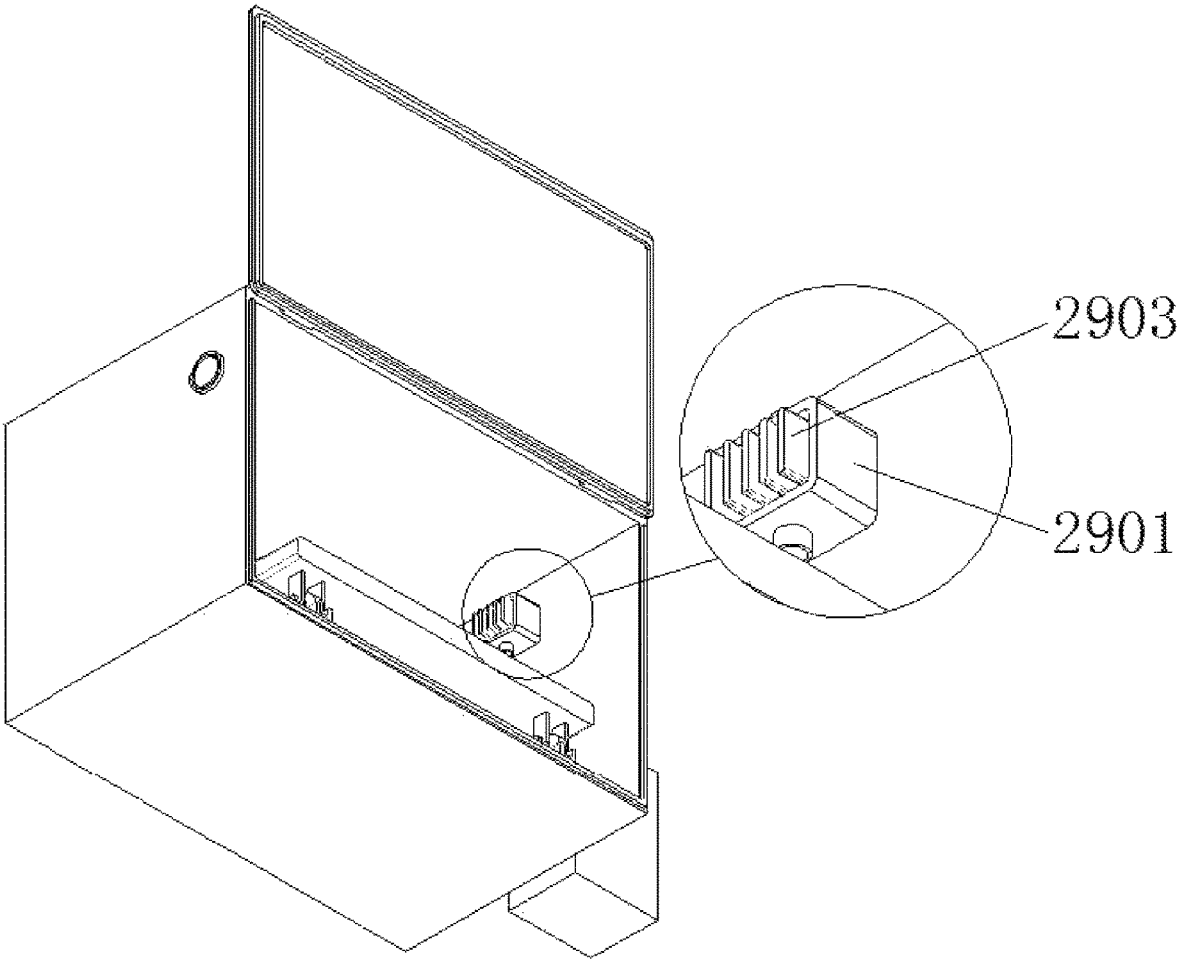
FIG. 19 is a first perspective schematic diagram of a first storage housing of an embodiment of the present disclosure.
Figure 21:
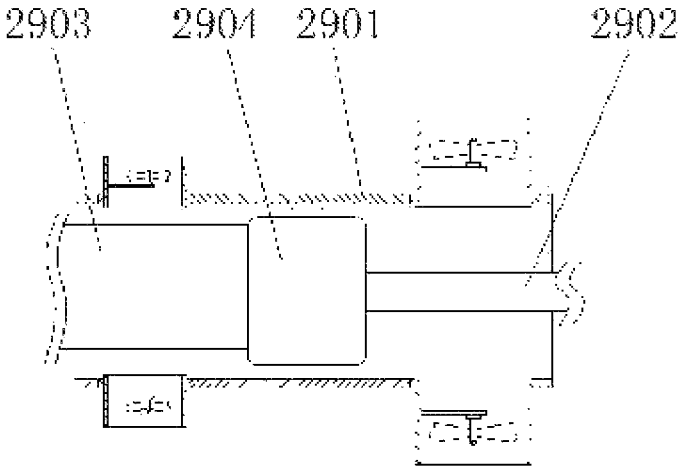
FIG. 21 is a partial section view of a fixing housing of an embodiment of the present disclosure.

In some embodiment of the present disclosure, as shown in FIG. 18, the low-temperature assembly 3 includes a cooling mechanism used for reducing an air temperature and a first storage housing 301, the first storage housing is a hollow housing with an opening in a front side, a first cover body 28 used for covering the opening is arranged on one side of the opening of the first storage housing by a hinge, and the first cover body is made of a transparent material, such that an experimenter can observe the vital sign change of an animal in a low-temperature environment through the first cover body made of the transparent material; and as shown in FIG. 19 and FIG. 21, the cooling mechanism 29 includes a semiconductor chilling plate 2904, a fixing housing 2901 for storing the semiconductor chilling plate, a heat dissipation copper pipe 2902 arranged at a heat dissipation end of the semiconductor chilling plate and a cold conduction block 2903 arranged at a chilling end of the semiconductor chilling plate, the fixing housing is of a hollow structure with openings in two sides, one side of the fixing housing penetrates the first storage housing and extends into the first storage housing, the other side of the fixing housing is retained outside the first storage housing, and the cold conduction block and the chilling end of the semiconductor chilling plate are located in the first storage housing.

In some embodiments of the disclosure, the model of the semiconductor chilling plate may be TEC1-12704 semiconductor chilling plate, when the device starts to be used, the semiconductor chilling plate starts to work, the heat dissipation copper pipe may dissipate heat of the heat dissipation end of the semiconductor chilling plate, the cold conduction block may dissipate cold air of the chilling end of the semiconductor chilling plate, and the chilling end of the semiconductor chilling plate is located in the first storage housing, so as to conveniently cool the interior of the first storage housing.

With reference to FIG. 21 in the accompanying drawings of the specification, a fan is arranged near the cold conduction block and the heat dissipation copper pipe, such that the cold air diffusion strength is enhanced, the heat dissipation efficiency of the heat dissipation copper pipe is improved, and on the basis that the heat dissipation efficiency of the heat dissipation copper pipe is improved, cold air output of the chilling end is greatly improved.

Figure 22:
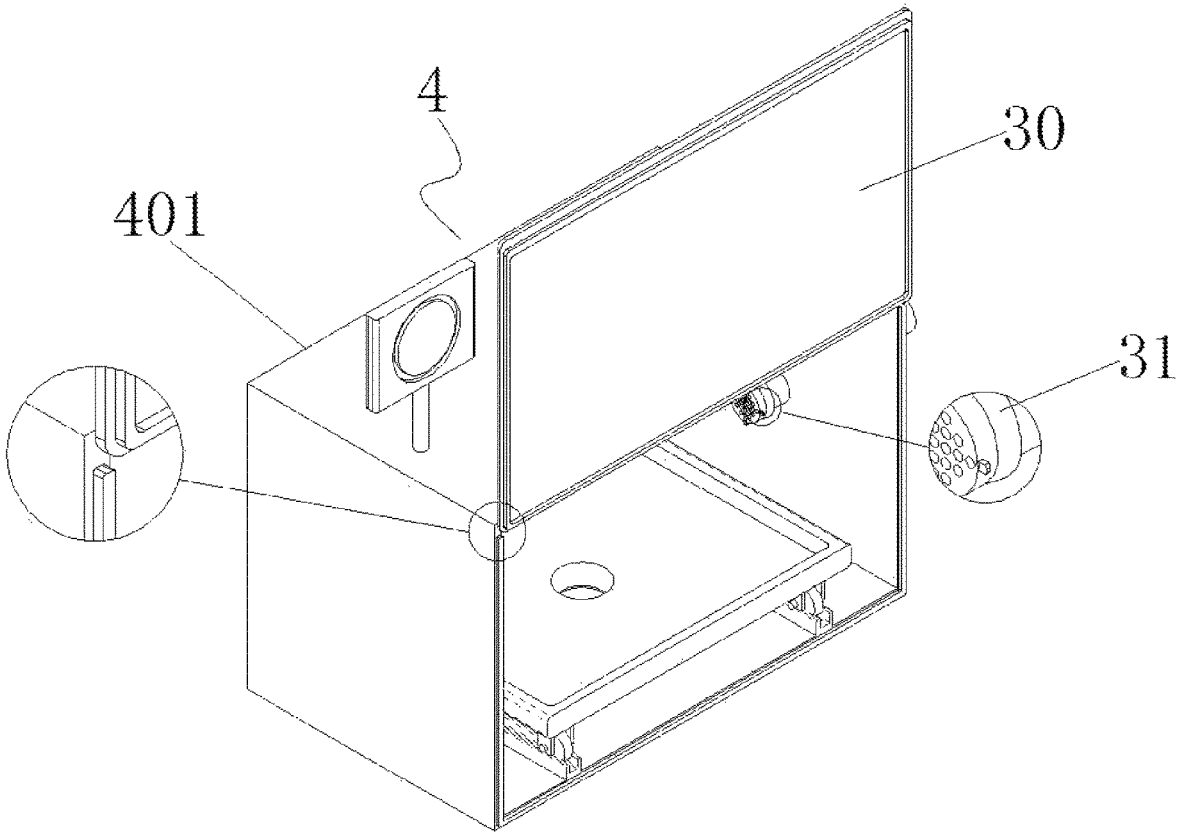
FIG. 22 is a partial schematic diagram of a low-pressure assembly of an embodiment of the present disclosure.
Figure 23:
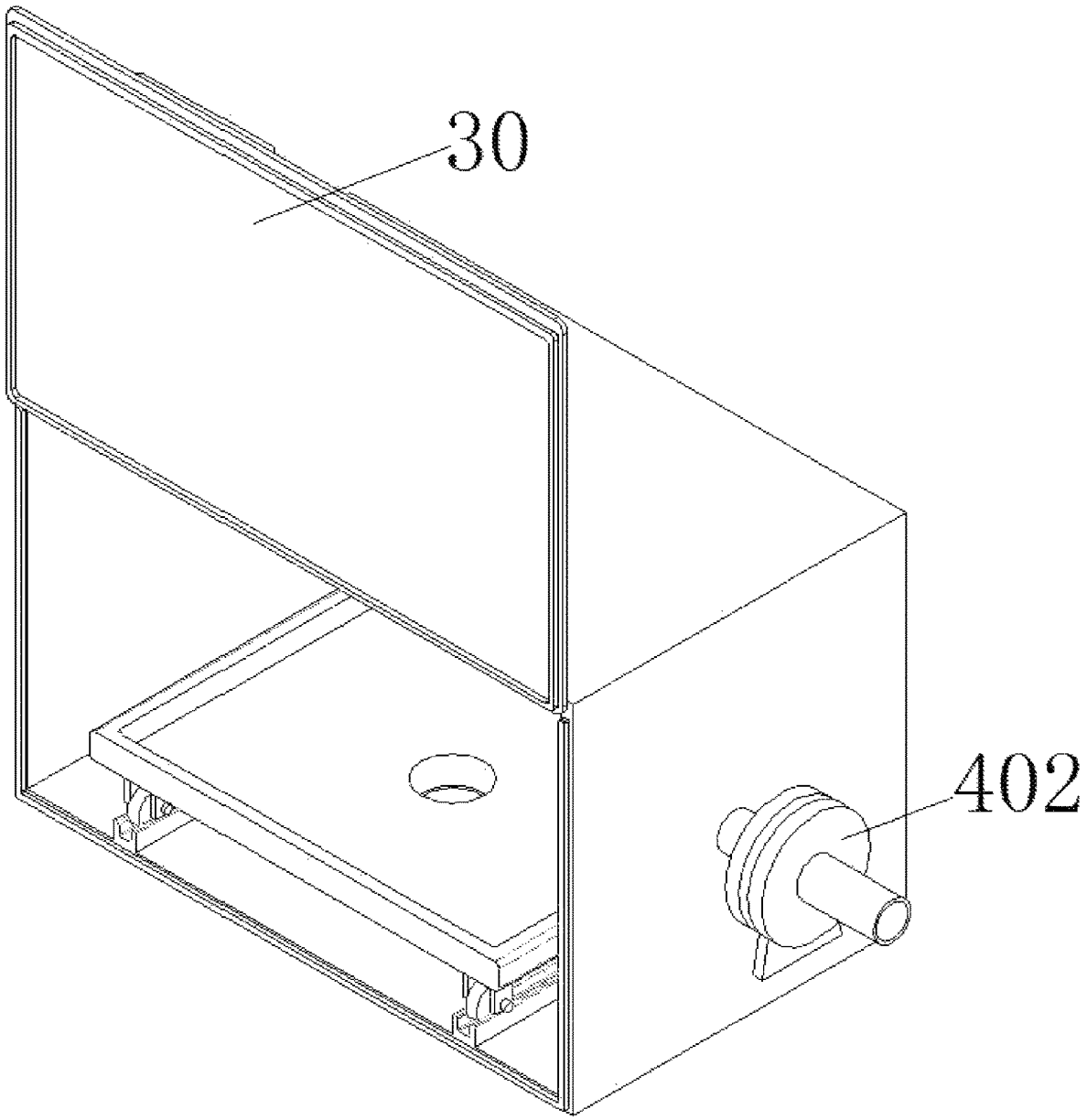
FIG. 23 is a perspective schematic diagram of a second storage housing of an embodiment of the present disclosure.

In some embodiment of the present disclosure, as shown in FIGS. 22 and 23, the low-pressure assembly 4 includes a second storage housing 401 and a vacuum pump arranged on one side of the second storage housing, the input end of the vacuum pump is connected with an explosion-proof pipe penetrating the second storage housing and extending into the second storage housing and a filtering mechanism for preventing hair from blocking the vacuum pump, in an embodiment, the model of the vacuum pump is FUJ-PCV vacuum pump; and the second storage housing is a hollow housing with an opening in a front side, a second cover body 30 used for covering the opening is arranged on one side of the opening of the second storage housing by a hinge, the second cover body is made of a transparent material, a barometer used for monitoring an air pressure value in the second storage housing is arranged at a top of the second storage housing, and an induction end at a bottom of the barometer penetrates the second storage housing and extends into the second storage housing, such that an experimenter may observe the vital sign change of an injured animal in a low-temperature environment through the second cover body made of the transparent material. In an embodiment, the model of the barometer is Y-60BF barometer, when the vacuum pump starts to work, the experimenter may selectively adjust a service time and an output power of the vacuum pump according to experiment requirements to pump out air in the second storage housing, when more air is pumped out, the air pressure is lower, when less air is pumped out, the air pressure is higher, so as to achieve the purpose of adjusting the low pressure in the second storage housing, at the moment, the vital sign changes of the injured animals in different low-pressure environments of the second storage housing are observed, and the other point needing to be emphasized is that the experimenter may master the air pressure condition in the second storage housing at any time according to a reading displayed on the barometer; and the filtering mechanism includes a sleeve 31 which sleeves one side of an air inlet of an explosion-proof pipe and is used for primarily filtering hair, a non-woven fabric which is arranged on a cross section of one side of the air inlet of the explosion-proof pipe and is used for secondarily filtering the hair, and a locking member which is used for fixing the sleeve on the explosion-proof pipe, an airflow hole is provided in a surface of one side of the sleeve, it is to be emphasized that when the vacuum pump starts to work, the air in the second storage housing must be pumped out by the explosion-proof pipe, at the moment, the air must firstly flow through the sleeve, hair possibly falling off from the animal is primarily intercepted and filtered by means of the arrangement of the special airflow holes of the sleeve, the air continues to flow till the air flows into the explosion-proof pipe, at the moment, the non-woven fabric may secondarily filter the air, short broken hair and dust particles possibly doped in the air is further intercepted by utilizing the special micropore permeability of the non-woven fabric, and the air pumped by the vacuum pump is effectively filtered by utilizing a double-filtration structure, such that the vacuum pump is prevented from being blocked, and the hole diameter of the airflow hole is 0.2 cm-0.5 cm.

Figure 24:
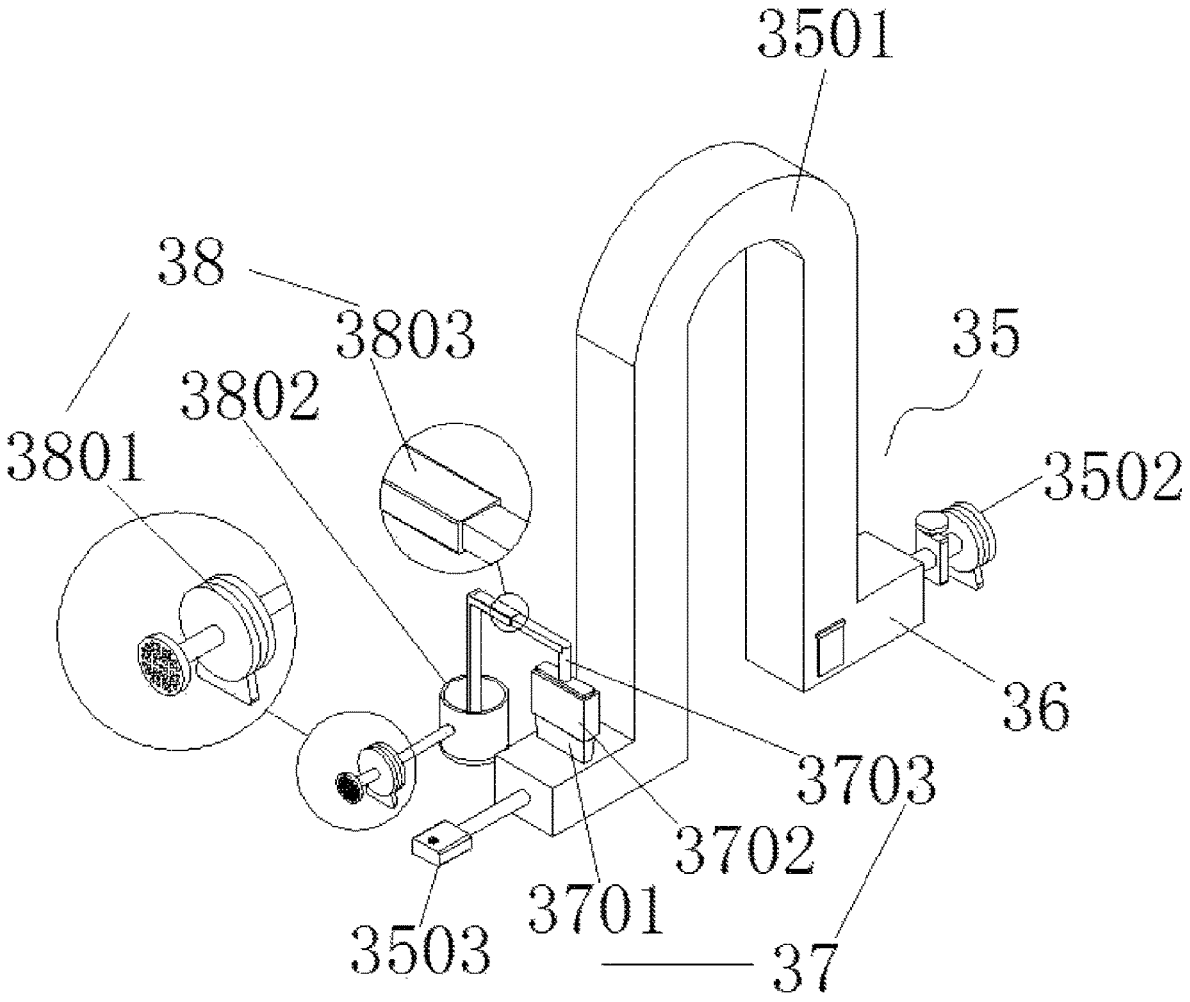
FIG. 24 is a schematic diagram of a burning assembly of an embodiment of the present disclosure.
Figure 25:
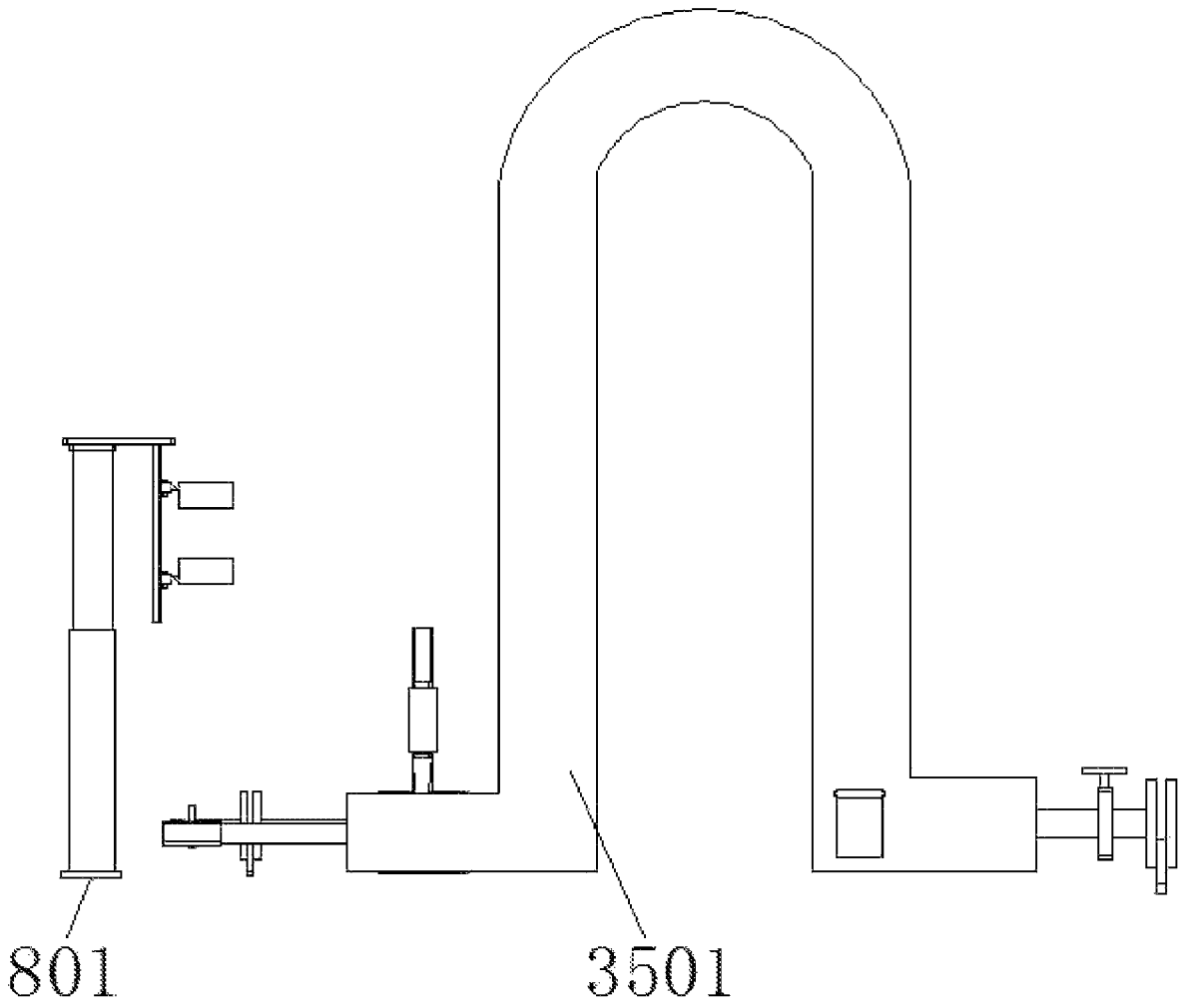
FIG. 25 is a schematic diagram of cooperative use of the burning assembly and a binding assembly of an embodiment of the present disclosure.

In some embodiments of the present disclosure, as shown in FIG. 24, the burning assembly 5 includes an ignition mechanism 35 used for ignition and an adjustment mechanism 37 used for absorbing fuel moisture and avoiding burning death of the animal, the ignition mechanism 35 includes an inverted U-shaped pipe 3501 used for accommodating fuel, an air pump 3502 and a pulverized coal igniter 3503, wherein two ends of the inverted U-shaped pipe extend to be provided with buffer housings 36 in a communicating mode, one buffer housing is in communication with the air pump, and the other buffer housing is in communication with the pulverized coal igniter; and it is to be emphasized that the fuel mentioned in some embodiments of the disclosure is pulverized coal, the model of the air pump is 4389ML air pump, when an experimenter needs to ignite to burn an animal, the pulverized coal needs to be placed in the buffer housing adjacent to the air pump firstly, at the moment, the air pump starts to work, the pulverized coal is blown into the other buffer housing by means of the inverted U-shaped pipe and is discharged to the pulverized coal igniter for ignition, and it is to be emphasized that the inverted U-shaped pipe is designed to serve as a buffer section in a pulverized coal conveying process, such that the situation that a large amount of pulverized coal directly flows into the pulverized coal igniter under the action of the air pump, and then overlarge fire behavior and fuel waste are caused is avoided.

In some embodiments, as shown in FIG. 24, the adjustment mechanism 37 includes a semiconductor chilling plate 3702, a heat dissipation copper plate 3701 arranged at a heat dissipation end of the semiconductor chilling plate, a cold conduction block 3703 arranged at a chilling end of the semiconductor chilling plate, and a spraying mechanism 38 used for spraying low-temperature liquid water, one end of the heat dissipation copper plate 3701 penetrates the buffer housing adjacent to the pulverized coal igniter and extends into the buffer housing, a pressure reduction opening is provided in a portion, extending into the buffer housing, of the heat dissipation copper plate, and a caliber of the pressure reduction opening is gradually reduced from a fuel inlet end to a fuel outlet end, it is to be emphasized that the model of the semiconductor chilling plate may be TEC1-12704 semiconductor chilling plate, in the fuel conveying process, the semiconductor chilling plate starts to work, the heat dissipation copper plate absorbs the high temperature of the heat dissipation end of the semiconductor chilling plate, at the moment, when the fuel passes through the pressure reduction opening, the heat dissipation copper plate can effectively absorb moisture doped in the fuel, the caliber of the pressure reduction opening is gradually reduced from one side to the other side, accordingly, the situation that absorption of moisture doped in the fuel is influenced due to too fast fuel fluidity is avoided, and when the burn area of an animal is too large, the spraying mechanism is used for extinguishing fire and cooling the animal in time.

Figure 27:
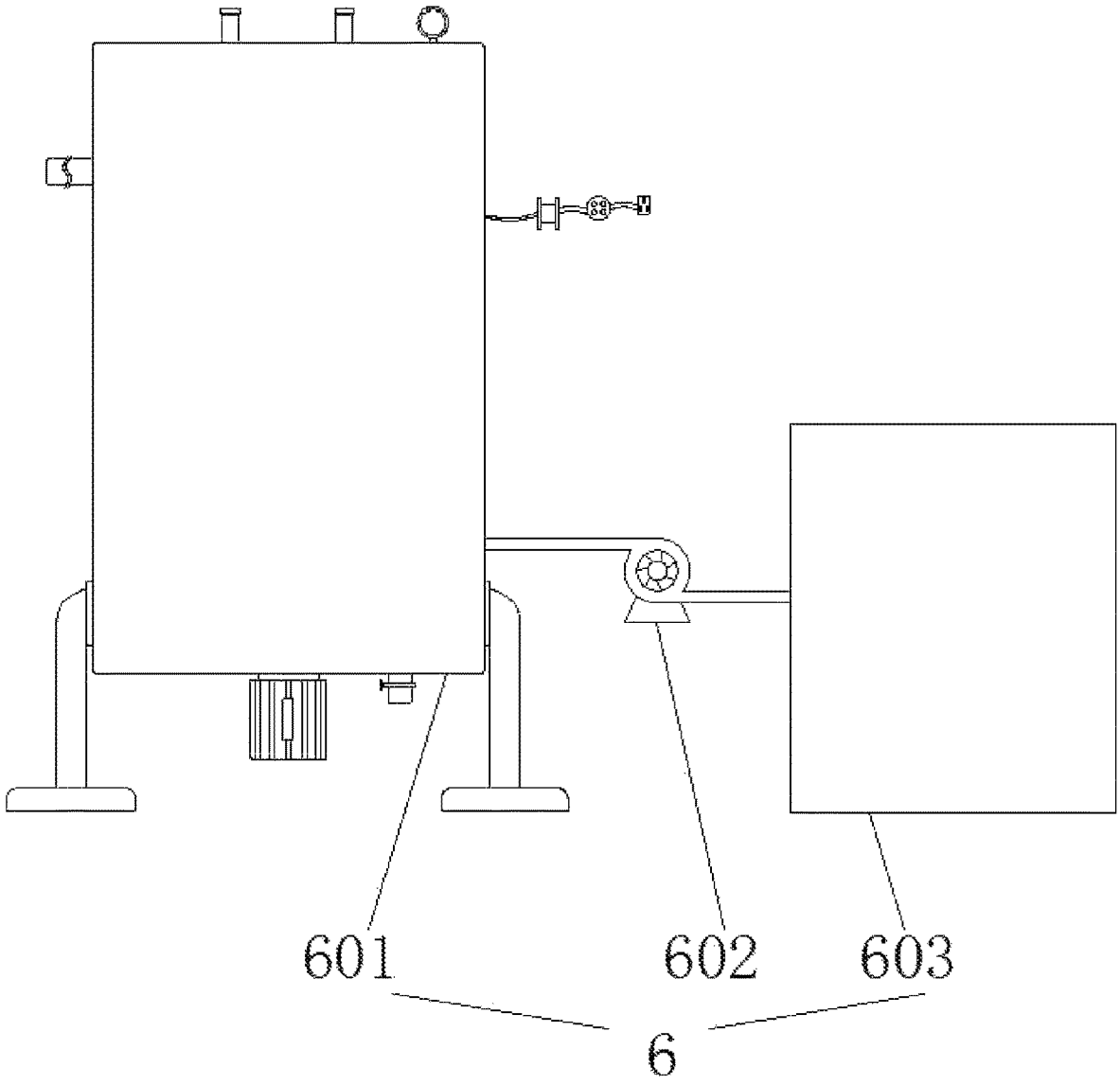
FIG. 27 is a schematic diagram of a seawater soaking assembly of an embodiment of the present disclosure.
Figure 28:
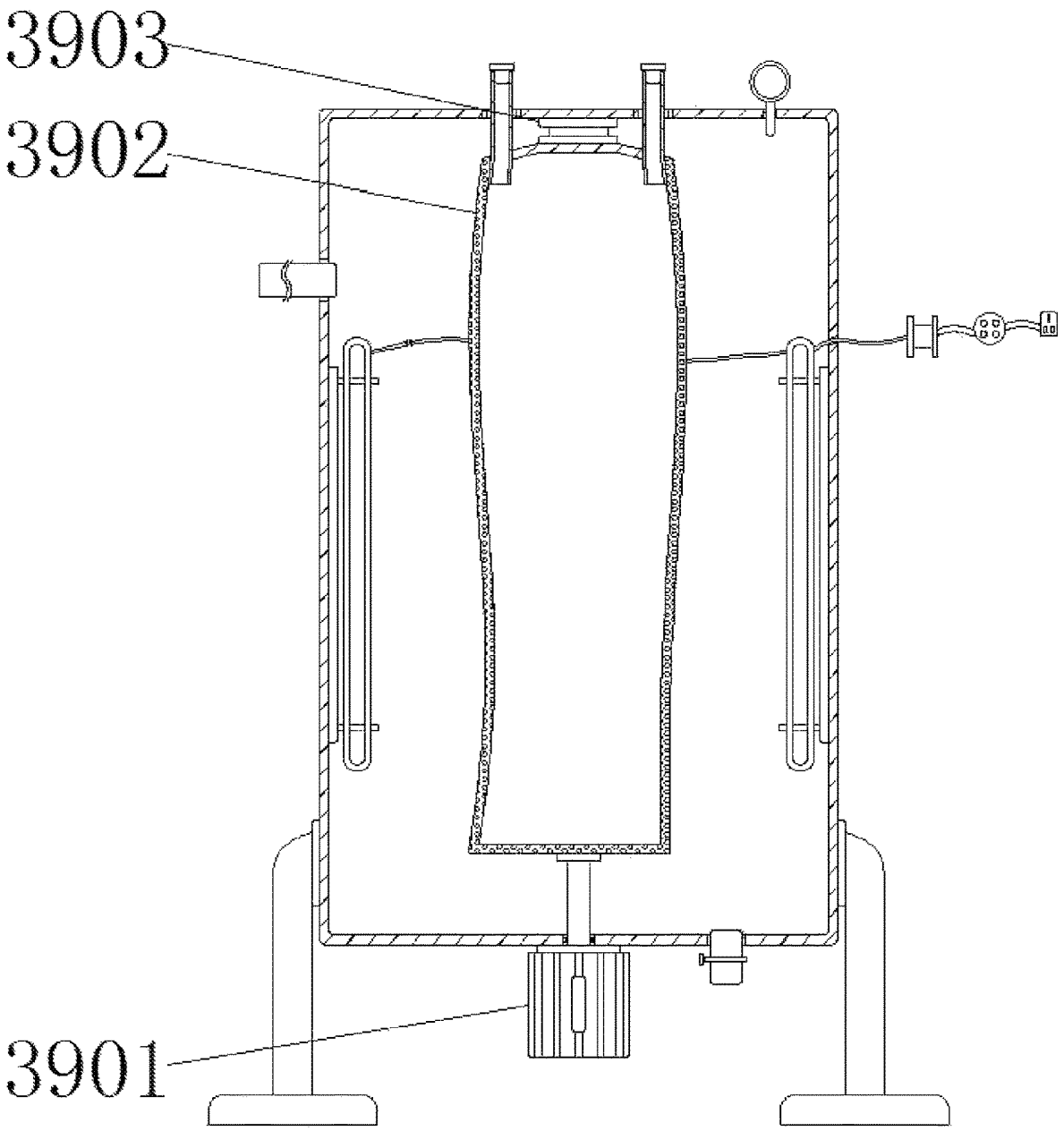
FIG. 28 is a partial section view of a third storage housing of an embodiment of the present disclosure.
Figure 29:
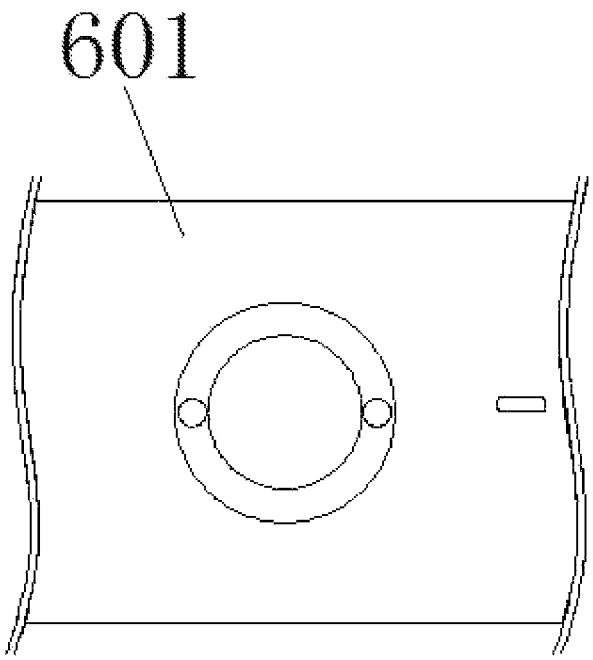
FIG. 29 is a partial top view of the third storage housing of an embodiment of the present disclosure.
Figure 30:
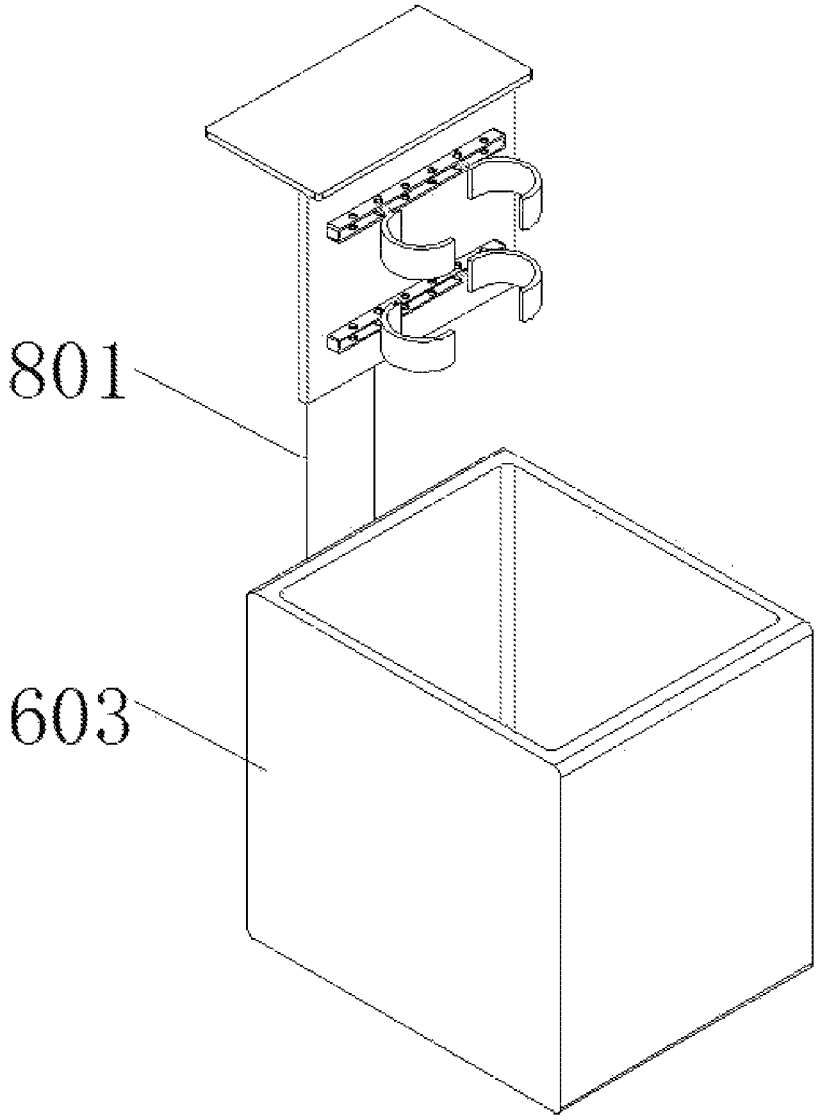
FIG. 30 is a schematic diagram of cooperative use of a water storage tank and the binding assembly of an embodiment of the present disclosure.

In some embodiments of the present disclosure, as shown in FIGS. 27-29, the seawater soaking assembly 6 includes a third storage housing 601 used for accommodating a solvent, a liquid inlet pipe in communication with one side of the third storage housing, a liquid outlet pipe in communication with a bottom of the third storage housing, a one-way valve arranged on the liquid outlet pipe, a water storage tank 603 used for accommodating the injured animal for seawater soaking, a water pump 602 used for communicating the third storage housing and the water storage tank, and an acceleration mechanism 39 used for accelerating a dissolution rate of solute in the solvent, the solvent is injected into the third storage housing by the liquid inlet pipe, after the solute and the solvent are mixed to obtain seawater, the seawater is pumped into the water storage tank by the water pump for use, the one-way valve is opened when the remaining seawater is used, and the remaining seawater is discharged by the liquid outlet pipe, the solvent mentioned in some embodiments of the disclosure is mineral water or purified water, the solute is seawater crystal, and the model of the water pump is JTP-1800 water pump;

the acceleration mechanism 39 includes a non-woven fabric bag 3902 arranged in the third storage housing and used for storing solute, an electric motor 3901 arranged at a bottom of the third storage housing and a rotary disc 3903 arranged at a top end in the third storage housing and connected with the non-woven fabric bag, a rotating shaft at an output end of a top of the electric motor penetrates the third storage housing and extends into the third storage housing to be connected to the non-woven fabric bag, and a bearing is arranged at a joint between the rotating shaft and the third storage housing, wherein an outer ring of the bearing is connected with an inner wall of the third storage housing, an inner ring of the bearing is connected with the rotating shaft, in some embodiments, the model of the electric motor is 60KTYZ electric motor, and the solute is soaked in a solution to make contact with the solution by utilizing the micropore permeability of the non-woven fabric bag;

a salinometer is arranged at a top of the third storage housing, an induction end of a bottom of the salinometer penetrates the third storage housing and extends into the third storage housing, support columns used for supporting the third storage housing are arranged on two sides of the third storage housing, and in some embodiments, the model of the salinometer is LS10T salinometer; and a circular channel extending into the hollow interior of the third storage housing is provided in the top of the third storage housing, feeding pipes are arranged at two ends of a top of the non-woven fabric bag, the tops of the feeding pipes passes through the circular channel and then penetrates out of the third storage housing, the electric motor drives the non-woven bag to rotate by the rotating shaft, then the feeding pipes rotate on an inner side of the annular channel, with reference to the accompanying drawing 29 in the specification, the feeding pipe rotates on the inner side of the annular channel while rotating along with the non-woven fabric bag, and accordingly, the situation that rotation of the feeding pipe is influenced due to the phenomenon of sticking and locking is avoided.

Figure 31:
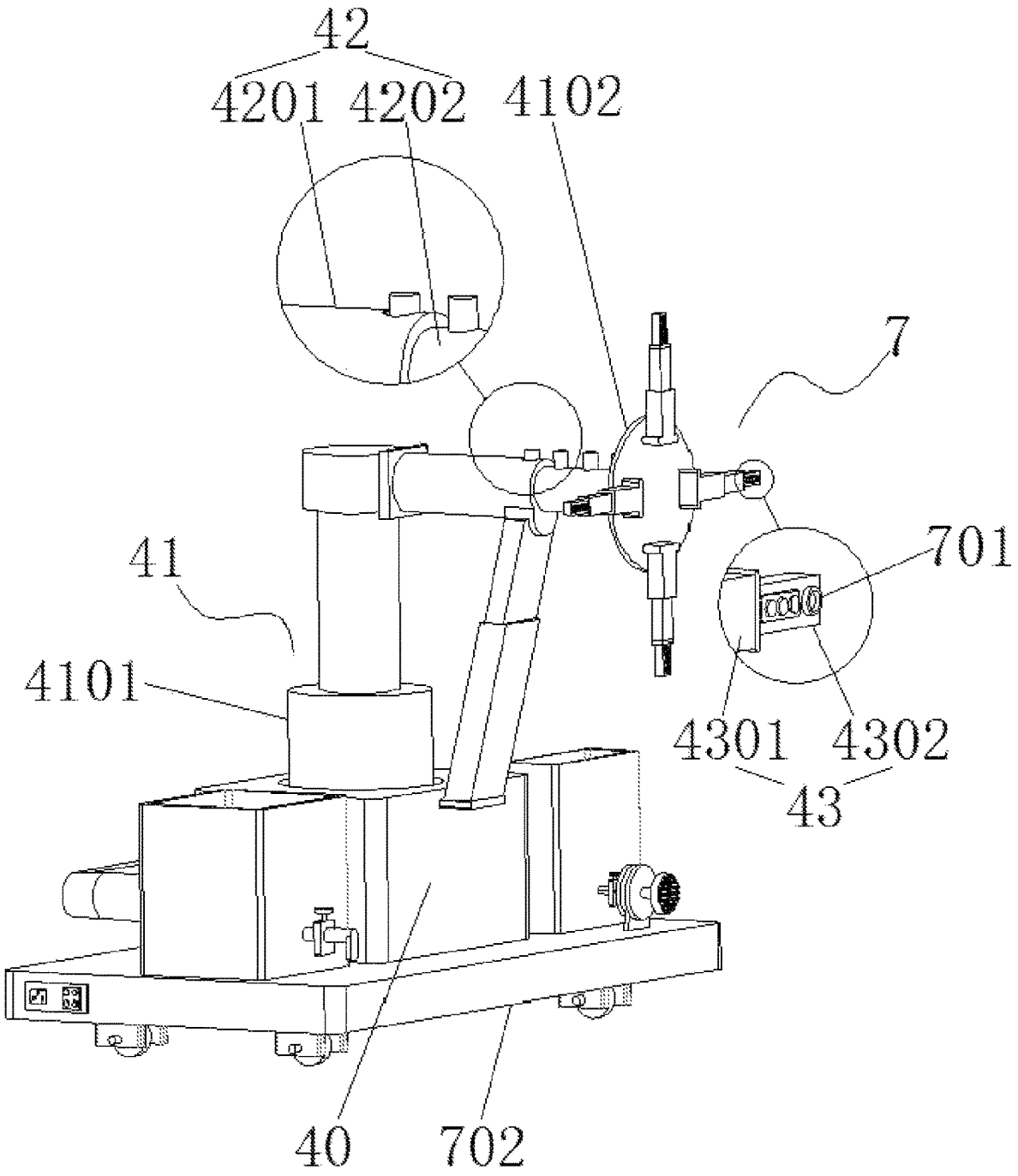
FIG. 31 is a first perspective schematic diagram of a photographing assembly of an embodiment of the present disclosure.
Figure 32:
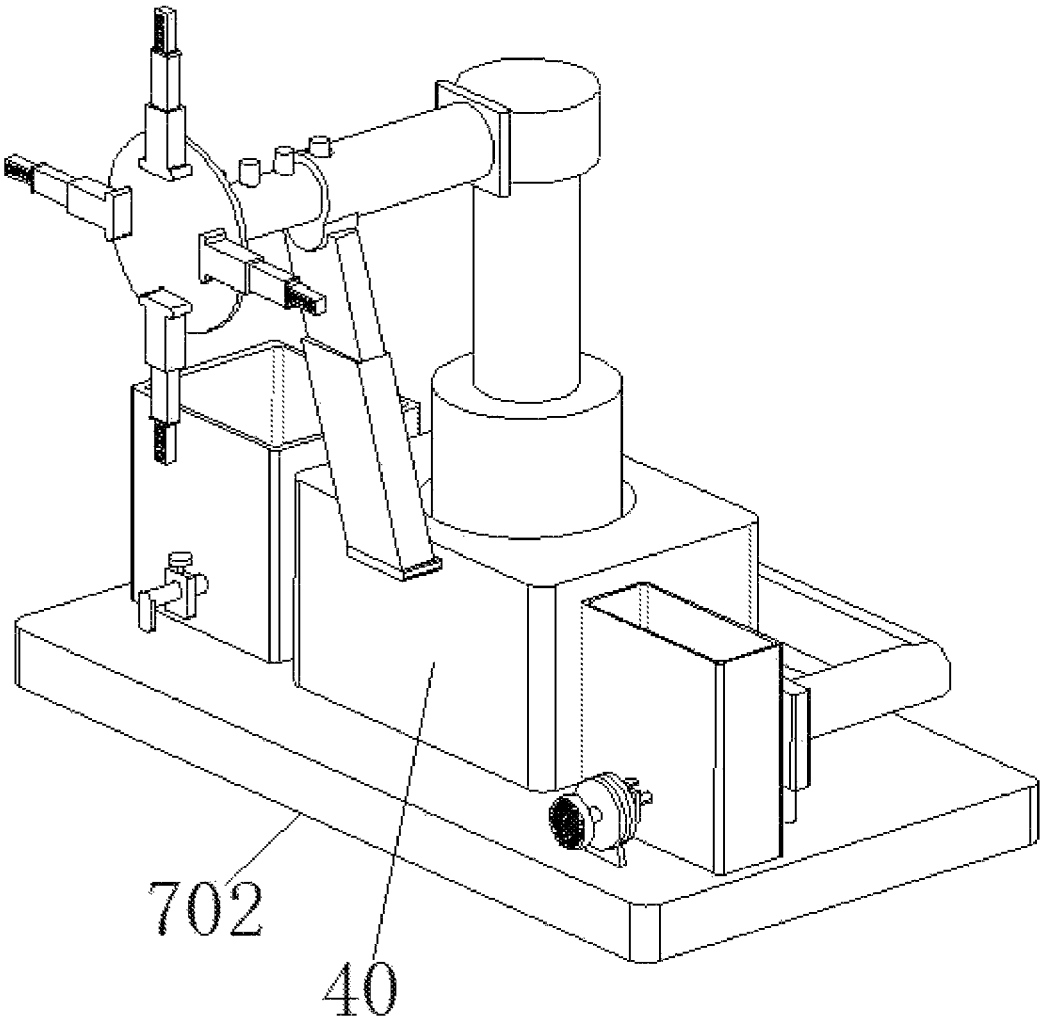
FIG. 32 is a second perspective schematic diagram of the photographing assembly of an embodiment of the present disclosure.
Figure 33:
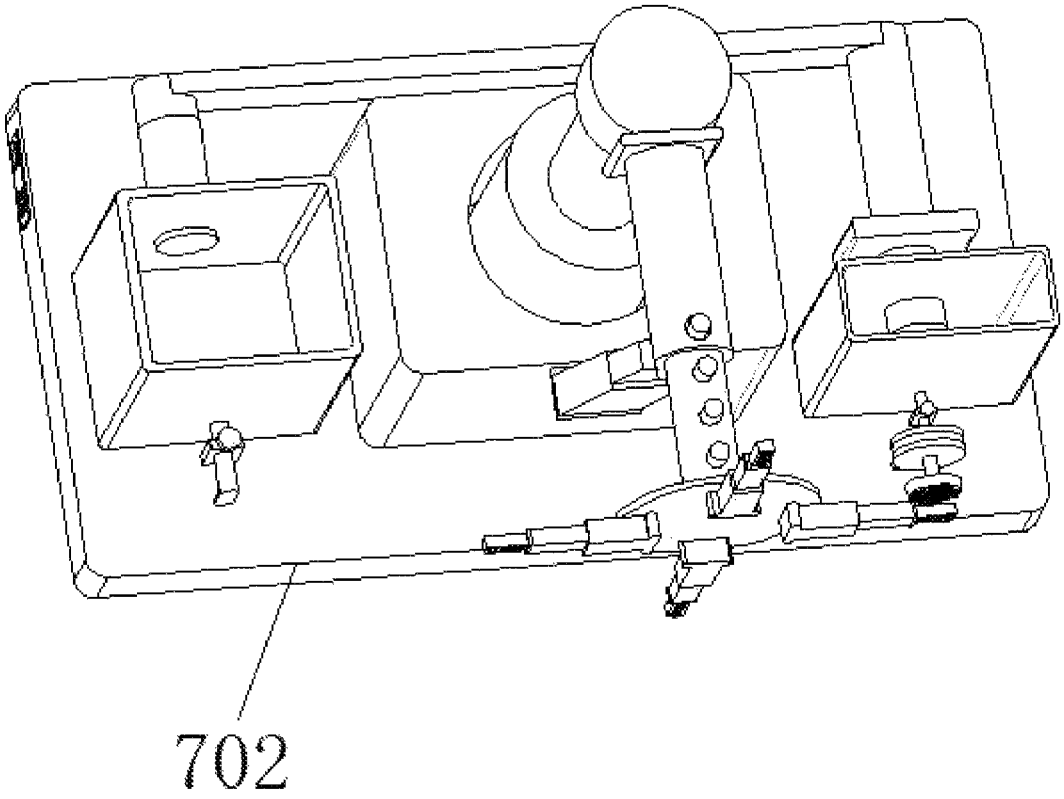
FIG. 33 is a third perspective schematic diagram of the photographing assembly of an embodiment of the present disclosure.

In some embodiments of the present disclosure, as shown in FIGS. 31-33, the photographing assembly 7 includes a high-speed camera 701, a telescopic mechanism 41 used for adjusting a photographing angle of the high-speed camera and a weight increasing bottom plate 702, universal wheels are arranged at a bottom of the weight increasing bottom plate;

at least four high-speed cameras are arranged, a fixing base 40 is arranged at a top of the weight increasing bottom plate, the telescopic mechanism 41 includes a first electric push rod 4101 arranged at a top of the fixing base, a telescopic member 42, a fixing plate 4102 and an extension mechanism 43 used for extension and distance adjustment of the high-speed cameras, the model of the high-speed camera disclosed in the technical solution of some embodiments of the disclosure is RYS high-speed camera, the model of the first electric push rod disclosed in the technical solution of some embodiments of the disclosure is JU-TGE electric push rod, and after a user moves the device to a required use place, the height of the device is adjusted by means of the first electric push rod so as to achieve the purpose of height-adjustable photographing according to the types of different animals.

In some embodiments of the present disclosure, the telescopic member 42 includes a telescopic sleeve rod 4201 and a telescopic rod 4202 which are hinged to an output end of a top of the first electric push rod, the telescopic sleeve rod is of a hollow structure with an opening in one end, the telescopic rod extends into the telescopic sleeve rod from the opening and is adjusted to extend and retract, a limiting hole penetrating into the hollow interior of the telescopic sleeve rod is provided in a surface of the telescopic sleeve rod, at least two elastic limiting keys clamped to the limiting hole are arranged on the telescopic rod, and the telescopic rod extends and retracts on an inner side of the telescopic sleeve rod and is clamped to an inner side of the limiting hole by means of the elastic limiting key, such that the telescopic rod is fixed to the inner side of the telescopic sleeve rod, after the height of the device is adjusted, the length between the telescopic rod and the telescopic sleeve rod is selectively adjusted according to the condition of a fire behavior required by an experiment, a user may press the elastic limiting key to make the elastic limiting key to retract inwards and be gradually disengaged from the inner side of the limiting hole, at the moment, the telescopic rod is in a movable state on the inner side of the telescopic sleeve rod, after the length of the telescopic rod is adjusted, the specific elastic limiting key is clamped to the inner side of the limiting hole, it is to be explained that in a fire experiment, when the fire behavior is larger and an animal size is larger, the telescopic rod may properly retract to the inner side of the telescopic sleeve rod, and when the fire behavior is smaller and the animal size is smaller, the telescopic rod may properly extend to the inner side of the telescopic sleeve rod, and as for the elastic limiting key provided in the disclosure, the structural principle of the elastic limiting key is disclosed in the authorized and disclosed utility model case "BIM-based building construction simulation device" (CN208281424U), which is not repeatedly described in the disclosure.

Figure 34:
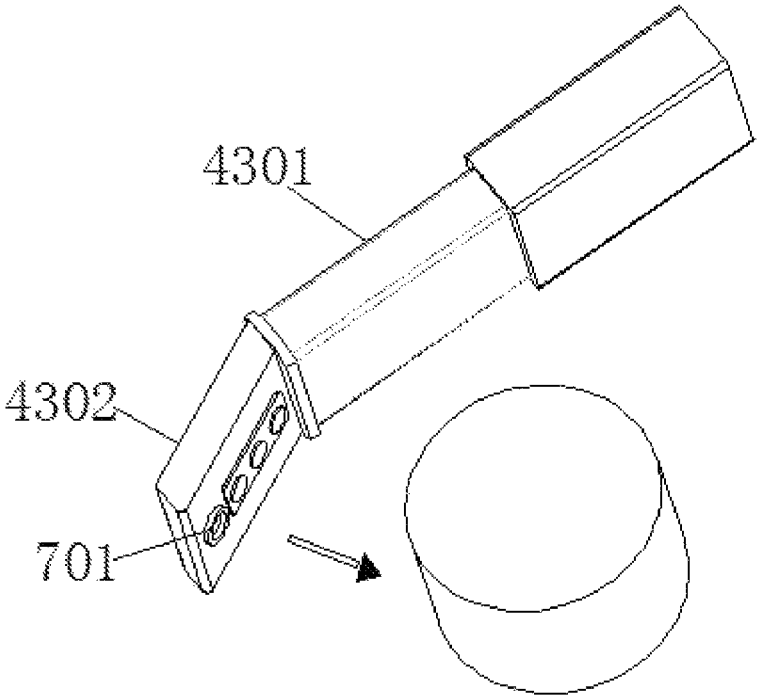
FIG. 34 is a schematic diagram of an adjustment plate, during bending work, of an embodiment of the present disclosure.

In some embodiments, the fixing plate 4102 is fixedly connected with one end of the telescopic rod, the at least four extension mechanisms are arranged, each extension mechanism includes a second electric push rod 4301 fixedly arranged on a front side of the fixing plate and an adjustment plate 4302 hinged to an output end of the second electric push rod, the at least four cameras are fixedly arranged on front sides of the at least four adjustment plates separately for multi-angle photographing, the model of the second electric push rod mentioned in the disclosure is HF-TGE electric push rod, after the height of the first electric push rod of the device is adjusted and the lengths of the telescopic sleeve rod and the telescopic rod are adjusted, the second electric push rod may selectively extend and retract according to the animal size, when the animal size is larger, the second electric push rod is properly lengthened, and when the animal size is smaller, the second electric push rod is properly shortened, and after the second electric push rod completes extension or retraction, the adjustment plate is bent by means of hinged connection between the second electric push rod and the adjustment plate, so as to achieve surrounding photographing on the animal body by the adjustment plate and the high-speed camera, with reference to the accompanying FIG. 34 in the specification.

Figure 26:
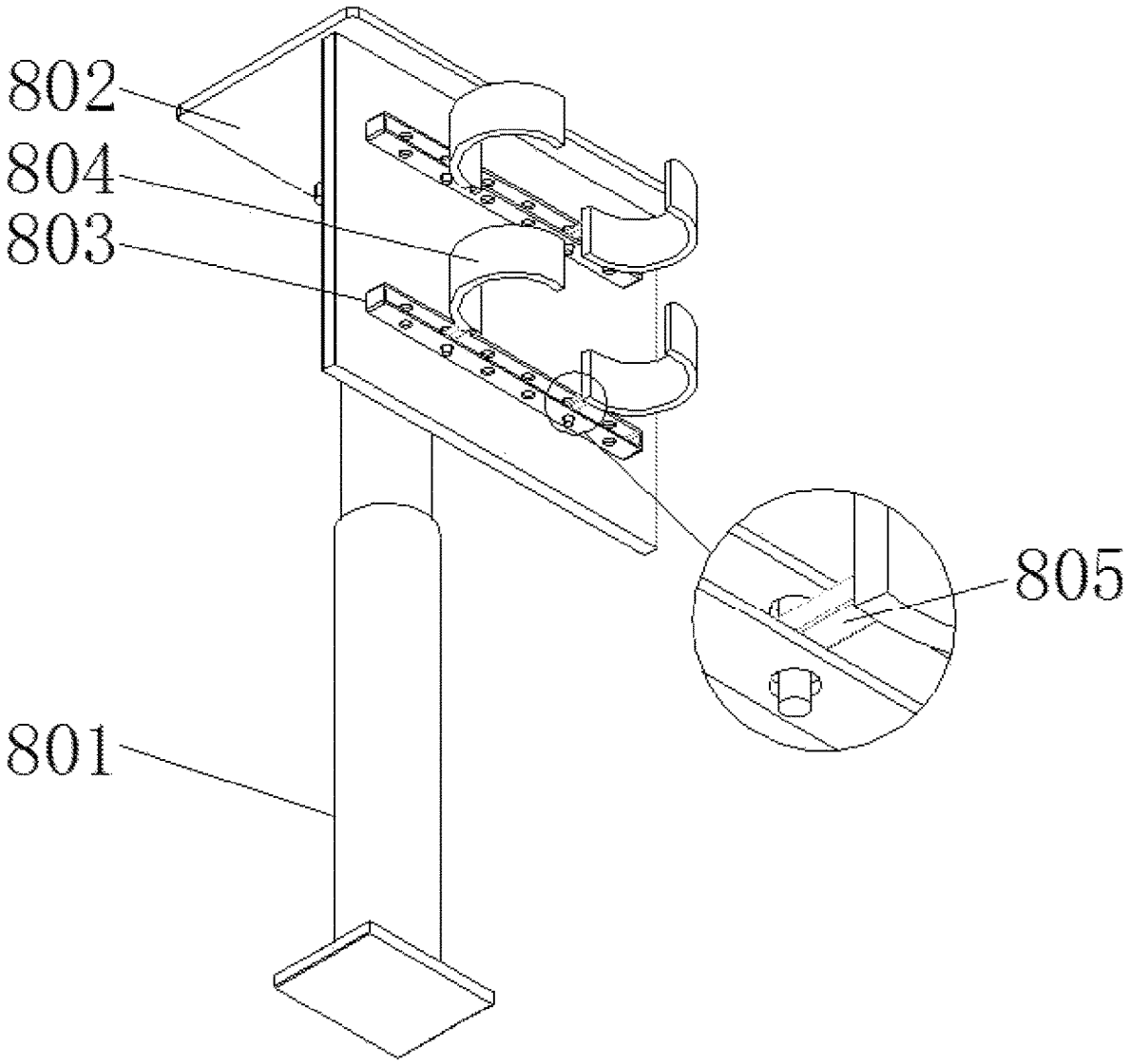
FIG. 26 is a schematic diagram of the binding assembly of an embodiment of the present disclosure.

In some embodiments of the present disclosure, as shown in FIG. 26, the binding assembly 8 includes a third electric push rod 801 and an L-shaped fixing plate 802 arranged at an output end of a top of the third electric push rod, and the binding assembly further includes two arc-shaped plates 804 used for clamping an injured animal body, a slide groove channel 803 provided in a surface of one side of the L-shaped fixing plate and slide groove blocks 805 arranged on one side of the arc-shaped plates, the slide groove channel is of a hollow structure with an opening in a surface, each slide groove block is embedded into a hollow inner side of the slide groove channel by means of the opening of the slide groove channel to restrictively slide, and the each slide groove block is capable of being fixed to the hollow inner side of the slide groove channel by a locking member, an experimenter places an animal on a front side of the L-shaped fixing plate and drives the arc-shaped plates to move relatively by means of the slide performance of the slide groove block on the inner side of the corresponding slide groove channel so as to clamp the animal body, then under the action of the third electric push rod, the third electric push rod ascends and descends to drive the L-shaped fixing plate and the animal to ascend and descend, on the premise that the animal is bound in advance, it is avoided that the four limbs of the injured animal swing and struggle, in the operation process of some embodiments of the disclosure, the animal does not need to be grasped manually for an injuring experiment, the brand-new binding assembly is used for clamping the animal, and the situation that the experimenter is injured accidentally when the animal is injured is avoided.

Figure 7:
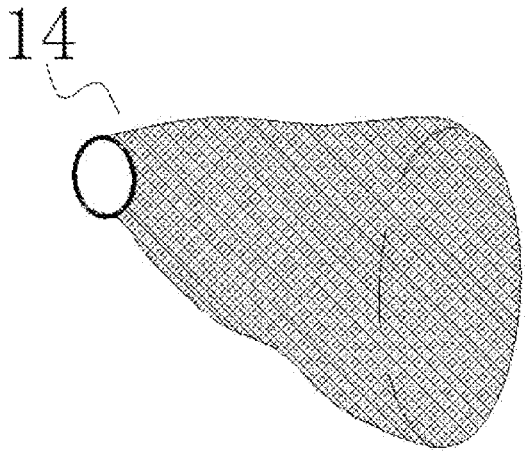
FIG. 7 is a structural schematic diagram of the protective cover of an embodiment of the present disclosure.
Figure 8:
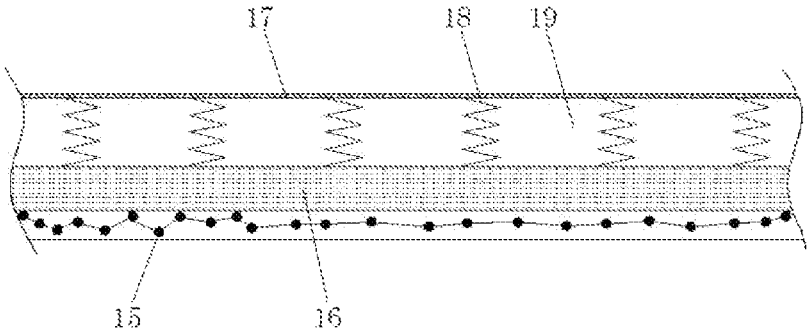
FIG. 8 is a partial section view of the protective cover of an embodiment of the present disclosure.
Figure 9:
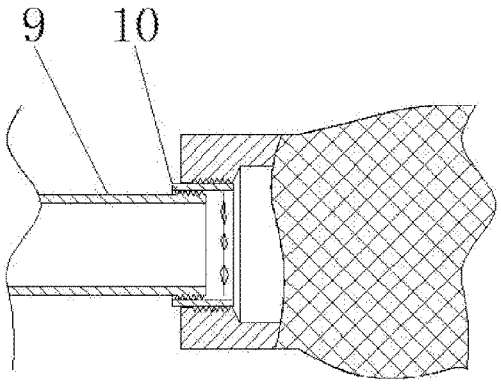
FIG. 9 is a connection schematic diagram of an energy accumulation pipe, the sleeve body and the protective cover of an embodiment of the present disclosure.

In some embodiments of the present disclosure, as shown in FIGS. 7 and 8, the universal platform for accurately injuring animal under multi-condition and multi-simulation-environment further includes a protective cover 14, the protective cover is a cover body with openings at two ends, one opening of the cover body is detachably connected with the sleeve body, the other opening thereof covers an injured part, and the cover body is made of a multi-layer structure, wherein the multi-layer structure at least includes a framework layer, a heat absorption layer stacked outside the framework layer and an energy absorption layer arranged outside the heat absorption layer in a sealed mode, the framework layer 15 is of a net structure made of metal wires, the heat absorption layer 16 is of a porous structure made of heat absorption materials, and the energy absorption layer 17 is a membrane made of elastic materials, wherein a heat insulation space is arranged between the membrane and the heat absorption layer in a sealed mode, a plurality of reset springs 18 are arranged in the heat insulation space, one end of each reset spring is fixed to the membrane, the other end of the each reset spring is fixed to the heat absorption layer, after shock waves enter the heat insulation space, the pressure of the space is increased, the membrane is elastically deformed, the heat insulation space is increased, the reset spring is stretched, the air pressure is reduced, and after the shock waves stop, the pressure of the heat insulation space is further reduced, the reset spring resets, and the heat insulation space recovers to an initial state and waits for the next shock.

Figure 20:
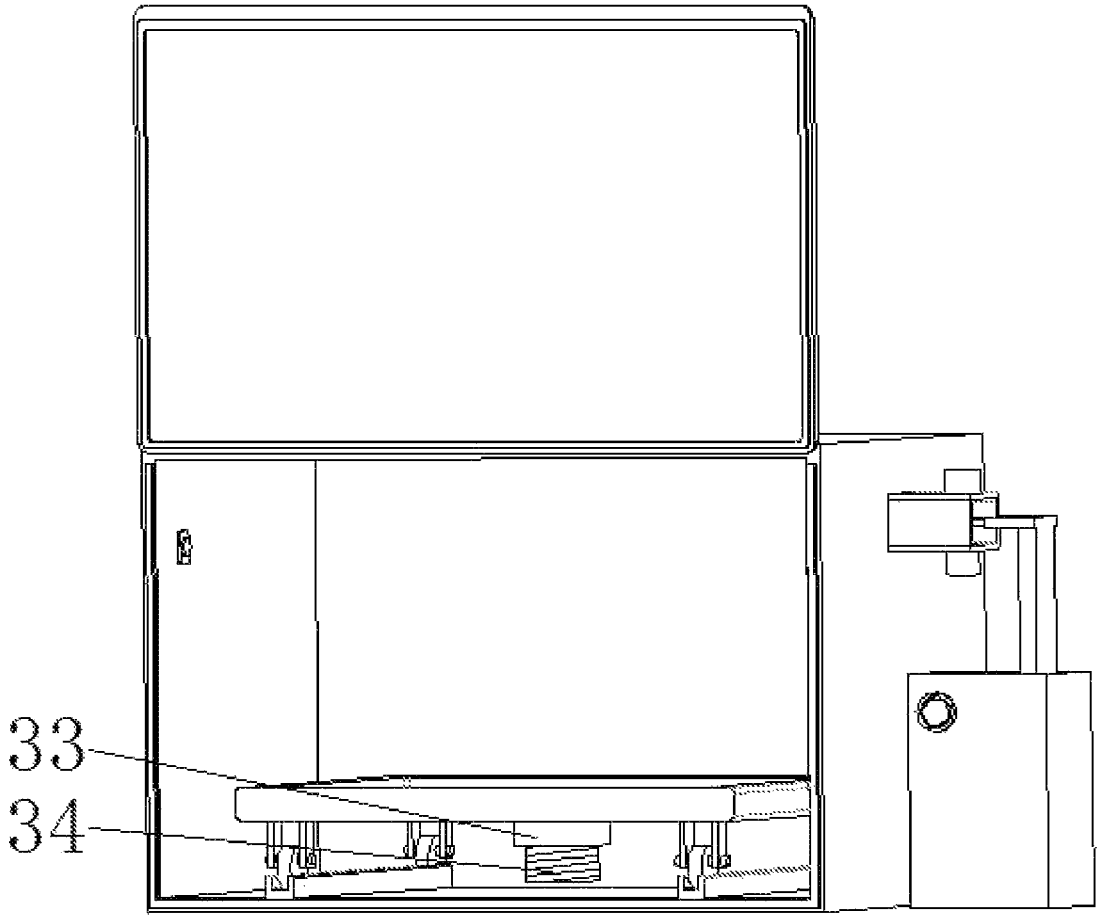
FIG. 20 is a second perspective schematic diagram of the first storage housing of an embodiment of the present disclosure.

In some embodiments of the present disclosure, as shown in FIG. 18 and FIG. 20, the universal platform for accurately injuring animal under multi-condition and multi-simulation-environment further includes an accommodation assembly 32 arranged in the first storage housing or the second storage housing and used for accommodating an animal, the accommodation assembly includes an accommodation housing 3201 arranged in the first storage housing or the second storage housing and used for accommodating an injured animal, a slide wheel 3202 arranged at a bottom of the accommodation housing, and a slide groove channel 3203 provided in a bottom end in the first storage housing or the second storage housing and used for restrictive sliding of the slide wheel, wherein the accommodation housing is of a recessed groove structure with a middle of a top end recessed, a sleeve base is arranged at a bottom of the accommodation housing, the sleeve base is of a hollow structure with openings in two ends, internal threads are arranged on an inner wall of the sleeve base in a surrounding mode, and an opening of a bottom of the sleeve base 33 is in threaded connection to a storage pipe 34 used for accommodating blood, according to the technical solution of the disclosure, the slide wheel slides on the inner side of the slide groove channel restrictively, an experimenter may place an animal on the top of the accommodation housing and push the animal into and out of the first accommodation housing, after an experiment is completed, the experimenter may conduct fixed-point cleaning on the accommodation housing, when the interior of the first accommodation housing does not have smudge, the whole first accommodation housing does not need to be cleaned, which reduces unnecessary workload of the experimenter, when the injured animal is placed on the top of the accommodation housing, due to different injury degrees, part of the injured animals are likely to have a bleeding phenomenon, then outflow blood can be collected by means of the collection assembly, and accordingly, the influence of blood random flowing in the first storage housing on subsequent cleaning of the interior of the first storage housing is avoided.

In some embodiments of the present disclosure, the locking member includes an elastic limiting key arranged at an outer edge of one side of an air inlet of the explosion-proof pipe and a limiting hole provided in the sleeve and clamped to the elastic limiting key, one side, sleeving the air inlet of the anti-explosion pipe, of the sleeve is clamped to an inner side of the limiting hole by means of the elastic limiting key, such that the sleeve is fixed to the anti-explosion pipe, and when the sleeve needs to be taken out to be cleaned, the elastic limiting key is pressed and then retract inwards until the elastic limiting key is disengaged from the inner side of the limiting hole, thereby achieving the purpose that the sleeve is disengaged from one side of the air inlet of the explosion-proof pipe. The non-woven fabric is located on the cross section of one side of the air inlet of the explosion-proof pipe, a user may slightly clean the non-woven fabric by means of a brush, after the sleeve is cleaned, the sleeve may be arranged on one side of the air inlet of the explosion-proof pipe in a sleeving mode again, and then the elastic limiting key is clamped to the inner side of the limiting hole again. It is to be emphasized herein that the structural principle of the elastic limiting key is disclosed in the authorized and disclosed utility model case "BIM-based building construction simulation device" (CN208281424U), which is not repeatedly described in the disclosure.

In some embodiments of the present disclosure, as shown in the FIG. 24, the spraying mechanism 38 includes a sleeve 3803 arranged at one end of the cold conduction block in a sleeving manner, a water storage housing used for containing stored water, and a water pump 3801 used for pumping cooled liquid water in the water storage housing 3802 to a spray head. The model of the water pump mentioned in some embodiments of the disclosure is JTP-1800 water pump, when the heat dissipation copper plate absorbs heat of the heat dissipation end of the semiconductor chilling plate, the cold conduction block transfers cold energy emitted by the chilling end of the semiconductor chilling plate to stored water in the water storage housing by the sleeve, when the burn area of an animal is too large, the water pump starts to work to pump the cooled liquid water in the water storage housing to the spray head to be sprayed out, so as to achieve the purpose of extinguishing fire and cooling the animal, and the sleeve is arranged, such that when the device needs to be moved, the sleeve is detached and moved, and then the purpose of separating and detaching the water pump, the spray head and the water storage housing together is achieved.

In some embodiments of the present disclosure, the locking member includes elastic limiting keys arranged at a top and a bottom of the slide groove block and at least two limiting holes which are provided on top and bottom surfaces of the slide groove channel and are clamped to the elastic limiting keys, the slide groove block slides on an inner side of the slide groove channel restrictively and is clamped to an inner side of the limiting hole by means of the elastic limiting key, such that the slide groove block is fixed to the hollow inner side of the slide groove channel, it is to be emphasized that the structural principle of the elastic limiting key is disclosed in the authorized and disclosed disclosure case "BIM-based building construction simulation device" (CN208281424U), which is not repeatedly described in the disclosure, and after slide adjustment of the slide groove block on the inner side of the slide groove channel is completed, the elastic limiting key is clamped to the inner side of the proper limiting hole, such that the slide groove block is fixed to the inner side of the slide groove channel.

In some embodiments of the present disclosure, the universal platform for accurately injuring animal under multi-condition and multi-simulation-environment may further include a shared bottom plate, and all the functional assemblies are arranged on the shared bottom plate.

Finally, it is noted that the above-mentioned embodiments are merely intended for description of the technical solutions of the present disclosure rather than limitation of the present disclosure. Although the present disclosure is described in detail with reference to the embodiments, those of ordinary skill in the art should understand that they may still make modifications or equivalent replacements to the technical solutions of the present disclosure without departing from the spirit and scope of the technical solutions of the present disclosure, all of which should be encompassed within the scope of the claims of the present disclosure.

What is claimed is:

1. An universal platform for accurately injuring animal under multi-condition and multi-simulation-environment, comprising a fragment assembly used for injuring the animal by means of a fragment, a shock wave assembly used for injuring the animal by means of shock waves, a low-temperature assembly for providing a low-temperature environment for an injured animal, a low-pressure assembly for providing a low-pressure environment for the injured animal, a burning assembly used for injuring the animal by means of burning, a seawater soaking assembly used for soaking the injured animal in seawater, a photographing assembly used for high-speed photography, and a binding assembly used for fixing the animal during fragment injury, shock wave injury, burning injury and seawater soaking;

the fragment assembly comprises a base, a compression chamber arranged on the base, and a fragment generator and a supercharger which are arranged at two ends of the compression chamber, the compression chamber being a closed housing, and openings being provided in two ends of the housing, wherein one opening, in the openings is in communication with the fragment generator, and the other opening in the openings is in communication with the supercharger;

the shock wave assembly comprises an injection pipe, a high-pressure chamber and an instant pressurization mechanism, a high-pressure cavity being provided in the high-pressure chamber and in communication with the instant pressurization mechanism by a high-pressure pipeline, one end of the injection pipe being in communication with the high-pressure cavity of the high-pressure chamber, the other end of the injection pipe extending close to an animal fixation position, and a high-pressure fracture film being arranged in the injection pipe in a sealed mode;

the low-temperature assembly comprises a cooling mechanism used for reducing an air temperature and a first storage housing, the first storage housing being a hollow housing with an opening in a front side, a first cover body used for covering the opening being arranged on one side of the opening of the first storage housing by a hinge, and the first cover body being made of a transparent material;

the low-pressure assembly comprises a second storage housing and a vacuum pump arranged on one side of the second storage housing, an input end of the vacuum pump being connected with an explosion-proof pipe passing through a side wall of the second storage housing and extending into the second storage housing and a filtering mechanism for preventing hair from blocking the vacuum pump; wherein the second storage housing is a hollow housing with an opening in a front side, a second cover body used for covering the opening is arranged on one side of the opening of the second storage housing by a hinge, the second cover body is made of a transparent material, a barometer used for monitoring an air pressure value in the second storage housing is arranged at a top of the second storage housing, and an induction end at a bottom of the barometer passes through a side wall of the second storage housing and extends into the second storage housing;

the burning assembly comprises an ignition mechanism used for ignition and an adjustment mechanism used for absorbing fuel moisture and avoiding burning death of the animal, the ignition mechanism comprising an inverted U-shaped pipe used for accommodating fuel, an air pump and a pulverized coal igniter, wherein two ends of the inverted U-shaped pipe extend to be provided with buffer housings in a communicating mode, one buffer housing is in communication with the air pump, and the other buffer housing is in communication with the pulverized coal igniter;

the seawater soaking assembly comprises a third storage housing used for accommodating solvent, a liquid inlet pipe in communication with one side of the third storage housing, a liquid outlet pipe in communication with a bottom of the third storage housing, a one-way valve arranged on the liquid outlet pipe, a water storage tank used for accommodating the injured animal for seawater soaking, a water pump used for communicating the third storage housing and the water storage tank, and an acceleration mechanism used for accelerating a dissolution rate of solute in solvent;

the photographing assembly comprises a high-speed camera, a telescopic mechanism used for adjusting a photographing angle of the high-speed camera and a weight increasing bottom plate, universal wheels being arranged at a bottom of the weight increasing bottom plate; wherein at least four high-speed cameras are arranged, a fixing base is arranged at a top of the weight increasing bottom plate, and the telescopic mechanism comprises a first electric push rod arranged at a top of the fixing base, a telescopic member, a fixing plate and an extension mechanism used for extension and distance adjustment of the high-speed cameras; and the telescopic member comprises a telescopic sleeve rod and a telescopic rod which are hinged to an output end of a top of the first electric push rod, the telescopic sleeve rod is of a hollow structure with an opening in one end, the telescopic rod extends into the telescopic sleeve rod from the opening and is adjusted to extend and retract, a limiting hole penetrating into a hollow interior of the telescopic sleeve rod is provided in a surface of the telescopic sleeve rod, at least two elastic limiting keys clamped into the limiting hole are arranged on the telescopic rod, and the telescopic rod extends and retracts on an inner side of the telescopic sleeve rod and is clamped to an inner side of the limiting hole by the elastic limiting key, such that the telescopic rod is fixed to the inner side of the telescopic sleeve rod.

2. The universal platform for accurately injuring animal under multi-condition and multi-simulation-environment according to claim 1, wherein the fragment generator comprises an energy accumulation pipe and a fragment generation mechanism detachably arranged at an end of the energy accumulation pipe, the fragment generation mechanism comprising a hollow sleeve body, a sheet arranged at an end of the sleeve body in a sealing manner and several fragments fixed in the sheet in a dispersed manner, wherein the sleeve body is fixedly connected to the energy accumulation pipe, the supercharger is a high-pressure air compressor, the high-pressure air compressor provides high-pressure air for the compression chamber, cracks are provided in a periphery of any of the fragments of the sheet, the sheet is broken at the cracks under the action of high-pressure air, and then the fragments pop out of the sleeve body.

3. The universal platform for accurately injuring animal under multi-condition and multi-simulation-environment according to claim 2, wherein the multi-condition multi-simulation-environment universal platform further comprises a protective cover, the protective cover being a cover body with openings at two ends, one opening of the cover body being detachably connected with the sleeve body, the other opening of the cover body covering an injured part, and the cover body being made of a multi-layer structure, wherein the multi-layer structure at least comprises a framework layer, a heat absorption layer stacked outside the framework layer and an energy absorption layer arranged outside the heat absorption layer in a sealed mode, the framework layer being of a net structure made of metal wires, the heat absorption layer being of a porous structure made of heat absorption materials, and the energy absorption layer being a membrane made of elastic materials, wherein a heat insulation space is arranged between the membrane and the heat absorption layer in a sealed mode, and a plurality of reset springs are arranged in the heat insulation space.

4. The universal platform for accurately injuring animal under multi-condition and multi-simulation-environment according to claim 1, wherein the instant pressurization mechanism comprises a housing, a sealing plate, a water inlet tank, a water inlet rod, a piston, a push rod and a water inlet driver, a high-temperature cavity accommodating a high-temperature medium being provided in the housing, the sealing plate being arranged above the high-temperature cavity in a liftable manner, the piston being arranged in the high-pressure cavity, one end of the push rod extending into the high-pressure cavity to be fixed to the piston, the other end of the push rod extending into the high-temperature cavity to be fixed to the sealing plate, the water inlet tank being provided below the housing, a water inlet hole being provided in an area, in the water inlet tank, of the housing, the water inlet rod being fixed to the water inlet tank by the water inlet driver in a liftable manner, and an end of the water inlet rod extending into the water inlet tank to seal the water inlet hole.

5. The universal platform for accurately injuring animal under multi-condition and multi-simulation-environment according to claim 1, wherein the cooling mechanism comprises a semiconductor chilling plate, a fixing housing for storing the semiconductor chilling plate, a heat dissipation copper pipe arranged at a heat dissipation end of the semiconductor chilling plate and a cold conduction block arranged at a chilling end of the semiconductor chilling plate, the fixing housing being of a hollow structure with openings in two sides, one side of the fixing housing penetrating the first storage housing and extending into the first storage housing, the other side of the fixing housing being retained outside the first storage housing, and the cold conduction block and the chilling end of the semiconductor chilling plate being located in the first storage housing.

6. The universal platform for accurately injuring animal under multi-condition and multi-simulation-environment according to claim 4, comprising an accommodation assembly arranged in the first storage housing or the second storage housing and used for accommodating the animal, the accommodation assembly comprising an accommodation housing arranged in the first storage housing or the second storage housing and used for accommodating an injured animal, a slide wheel arranged at a bottom of the accommodation housing, and a slide groove channel provided in a bottom end in the first storage housing or the second storage housing and used for restrictive sliding of the slide wheel, wherein the accommodation housing is of a recessed groove structure with a middle of a top end recessed, a sleeve base is arranged at a bottom of the accommodation housing, the sleeve base is of a hollow structure with openings in two ends, internal threads are arranged on an inner wall of the sleeve base in a surrounding mode, and an opening at a bottom of the sleeve base is in threaded connection to a storage pipe used for accommodating blood.

7. The universal platform for accurately injuring animal under multi-condition and multi-simulation-environment according to claim 1, wherein the filtering mechanism comprises a sleeve which sleeves one side of an air inlet of the explosion-proof pipe and is used for primarily filtering hair, a non-woven fabric which is arranged on a cross section of one side of the air inlet of the explosion-proof pipe and is used for secondarily filtering the hair, and a locking member which is used for fixing the sleeve on the explosion-proof pipe, an airflow hole being provided in a surface of one side of the sleeve.

8. The universal platform for accurately injuring animal under multi-condition and multi-simulation-environment according to claim 7, wherein the locking member comprises an elastic limiting key arranged at an outer edge of a side of an air inlet of the explosion-proof pipe and a limiting hole provided in the sleeve and clamped to the elastic limiting key, one side, sleeving the air inlet of the anti-explosion pipe, of the sleeve being clamped to an inner side of the limiting, hole by the elastic limiting key, such that the sleeve is fixed to the anti-explosion pipe.

9. The universal platform for accurately injuring animal under multi-condition and multi-simulation-environment according to claim 7, comprising an accommodation assembly arranged in the first storage housing or the second storage housing and used for accommodating the animal, the accommodation assembly comprising an accommodation housing arranged in the first storage housing or the second storage housing and used for accommodating an injured animal, a slide wheel arranged at a bottom of the accommodation housing, and a slide groove channel provided in a bottom end in the first storage housing or the second storage housing and used for restrictive sliding of the slide wheel, wherein the accommodation housing is of a recessed groove structure with a middle of a top end recessed, a sleeve base is arranged at a bottom of the accommodation housing, the sleeve base is of a hollow structure with openings in two ends, internal threads are arranged on an inner wall of the sleeve base in a surrounding mode, and an opening at a bottom of the sleeve base is in threaded connection to a storage pipe used for accommodating blood.

10. The universal platform for accurately injuring animal under multi-condition and multi-simulation-environment according to claim 1, wherein the adjustment mechanism comprises a semiconductor chilling plate, a heat dissipation copper plate arranged at a heat dissipation end of the semiconductor chilling, plate, a cold conduction block arranged at a chilling end of the semiconductor chilling plate, and a spraying mechanism used for spraying low-temperature liquid water, one end of the heat dissipation copper plate penetrating the buffer housing adjacent to the pulverized coal igniter and extending into the buffer housing, a pressure reduction opening is provided in a portion, extending into the buffer housing, of the heat dissipation copper plate, and a caliber of the pressure reduction opening being gradually reduced from a fuel inlet end to a fuel outlet end.

11. The universal platform for accurately injuring animal under multi-condition and multi-simulation-environment according to claim 10, wherein the spraying mechanism comprises a sleeve arranged at an end of the cold conduction block in a sleeving manner, a water storage housing used for containing stored water, and a water pump used for pumping cooled liquid water in the water storage housing to a spray head.

12. The universal platform for accurately injuring animal under multi-condition and multi-simulation-environment according to claim 1, wherein the acceleration mechanism comprises a non-woven fabric bag arranged in the third storage housing and used for storing solute, an electric motor arranged at a bottom of the third storage housing and a rotary disc arranged at a top end in the third storage housing and connected with the non-woven fabric bag, a rotating shaft at an output end of a top of the electric motor penetrating the third storage housing and extending into the third storage housing to be connected to the non-woven fabric, bag, and a bearing being arranged at a joint between the rotating shaft and the third storage housing, wherein an outer ring of the bearing is connected with an inner wall of the third storage housing, and an inner ring of the bearing is connected with the rotating shaft;

a salinometer is arranged at a top of the third storage housing, an induction end of a bottom of the salinometer penetrates the third storage housing and extends into the third storage housing, and support columns used for supporting the third storage housing are arranged on two sides of the third storage housing; and a circular channel extending into a hollow interior of the third storage housing is provided in the top of the third storage housing, feeding pipes are arranged at two ends of a top of the non-woven fabric bag, tops of the feeding pipes passing through the circular channel and then penetrating out of the third storage housing, and the electric motor drives the non-woven bag to rotate by the rotating shaft, such that the feeding pipes rotate on an inner side of the annular channel.

13. The universal platform for accurately injuring animal under multi-condition and multi-simulation-environment according to claim 1, wherein the fixing plate is fixedly connected with an end of the telescopic rod, at least four extension mechanisms are arranged, each extension mechanism comprises a second electric push rod fixedly arranged on a front side of the fixing plate and an adjustment plate hinged to an output end of the second electric push rod, and the at least four cameras are fixedly arranged on front sides of the at least four adjustment plates respectively for multi-angle photographing.

14. The universal platform for accurately injuring animal under multi-condition and multi-simulation-environment according to claim 1, wherein the binding assembly comprises a third electric push rod and an L-shaped fixing plate arranged at an output end of a top of the third electric push rod, and the binding assembly further comprises two arc-shaped plates used for clamping an injured animal body, a slide groove channel provided in a surface of one side of the L-shaped fixing plate and a slide groove block arranged on one side of each arc-shaped plate in the two arc-shaped plates, the slide groove channel being of a hollow structure with an opening in a surface, the slide groove block being embedded into a hollow inner side of the slide groove channel by the opening, of the slide groove channel to restrictively slide, and the slide groove block being capable of being fixed to the hollow inner side of the slide groove channel by a locking member.

15. The universal platform for accurately injuring animal under multi-condition and multi-simulation-environment according to claim 14, wherein the locking member comprises elastic limiting keys arranged at a top and a bottom of the slide groove block and at least two limiting holes which are provided on top and bottom surfaces of the slide groove channel and are clamped to the elastic limiting keys, the slide groove block sliding on an inner side of the slide groove channel restrictively and being clamped to an inner side of the limiting hole by a corresponding elastic limiting key, such that the slide groove block is fixed to the hollow inner side of the slide groove channel.

* * * * *